US008856995B2

(12) United States Patent
Arvinte et al.

(10) Patent No.: US 8,856,995 B2
(45) Date of Patent: Oct. 14, 2014

(54) SCREW BIT PUTTY KNIFE

(75) Inventors: Romeo Arvinte, Laval-des-Rapides (CA); Francois Panfili, Berthierville (CA)

(73) Assignee: A. Richard Tools Co./Outils A. Richard Co., Berthierville (Quebec) (CA)

( * ) Notice: Subject to any disclaimer, the term of this patent is extended or adjusted under 35 U.S.C. 154(b) by 266 days.

(21) Appl. No.: 13/290,703

(22) Filed: Nov. 7, 2011

(65) Prior Publication Data

US 2012/0137445 A1 Jun. 7, 2012

Related U.S. Application Data

(63) Continuation-in-part of application No. 11/999,258, filed on Dec. 3, 2007, now abandoned.

(60) Provisional application No. 60/861,973, filed on Dec. 1, 2006.

(51) Int. Cl.

| | |
|---|---|
| ***B25B 15/02*** | (2006.01) |
| ***B44D 3/16*** | (2006.01) |
| ***B25B 23/12*** | (2006.01) |
| ***B25F 1/00*** | (2006.01) |
| ***B25F 1/04*** | (2006.01) |
| ***B25B 23/00*** | (2006.01) |
| ***A47L 13/022*** | (2006.01) |

(52) U.S. Cl.

CPC ..... *A47L 13/022* (2013.01); *B25B 23/12* (2013.01); *B25F 1/006* (2013.01); *B25F 1/04* (2013.01); *B25B 15/02* (2013.01); *B25B 23/0028* (2013.01)

USPC ..... 7/165; 7/105

(58) Field of Classification Search

USPC ..... 7/165, 105, 158, 167, 143, 138, 168; 30/169, 158, 159; D8/105

See application file for complete search history.

(56) References Cited

U.S. PATENT DOCUMENTS

| | | | | | |
|---|---|---|---|---|---|
| 689,513 | A | * | 12/1901 | Papendell | 30/158 |
| 825,063 | A | | 7/1906 | Lawbaugh | |
| 2,092,586 | A | | 9/1937 | Stojan | |
| D142,468 | S | | 10/1945 | Bremer | |
| 2,810,194 | A | | 10/1957 | Unsinger | |
| 2,839,110 | A | | 6/1958 | Carpenter | |
| 3,774,252 | A | | 11/1973 | Cantales | |
| D258,043 | S | | 1/1981 | Gregoire | |

(Continued)

*Primary Examiner* — Hadi Shakeri

(74) *Attorney, Agent, or Firm* — Fish & Richardson P.C.

(57) ABSTRACT

A utility tool, such a putty knife, includes an elongated handle for manual handling of the utility tool, a blade and a screw bit assembly. The handle extends substantially along a longitudinal axis, and has front and rear portions. The blade has an anchoring portion anchored within the handle and an operating portion extending out from the front portion of the handle. The screw bit assembly is rotatably mounted about the rear portion of the handle, has a screw bit, and is operable between a non-operating configuration where the screw bit is nested within the handle, and an operating configuration where the screw bit is drawn out of the handle and securely maintained in a fixed configuration so as to be positioned at a slanted angle with respect to the longitudinal axis of the handle. In addition to being able to carry out other various functions, in drywall applications and the like, the tool by virtue of its design and components enables a more ergonomic grip, and to have a greater lever effect for screwing fasteners with its screw bit assembly.

10 Claims, 24 Drawing Sheets

(56) References Cited

U.S. PATENT DOCUMENTS

| | | | | |
|---|---|---|---|---|
| D263,277 | S | 3/1982 | Gregoire | |
| 5,063,627 | A | 11/1991 | Marra | |
| 5,251,352 | A | 10/1993 | Cullison | |
| D380,661 | S | 7/1997 | Lehmann | |
| 5,720,063 | A | 2/1998 | Chacon | |
| 5,870,786 | A | 2/1999 | Papadopoulos | |
| 5,927,164 | A | 7/1999 | Anderson et al. | |
| D414,395 | S | 9/1999 | Panfili | |
| D431,993 | S | 10/2000 | Panfili et al. | |
| 6,131,222 | A | 10/2000 | Anderson et al. | |
| D435,408 | S | 12/2000 | Panfili et al. | |
| 6,272,708 | B1 | 8/2001 | Chen | |
| 6,397,476 | B1 * | 6/2002 | Onion | 30/159 |
| D463,639 | S | 9/2002 | Panfili et al. | |
| 6,530,098 | B1 | 3/2003 | Gringer et al. | |
| D474,389 | S | 5/2003 | Panfili et al. | |
| 6,629,331 | B2 | 10/2003 | Panfili et al. | |
| 6,662,521 | B1 | 12/2003 | Escobedo et al. | |
| 6,719,620 | B1 | 4/2004 | Panfili et al. | |
| 6,726,868 | B1 | 4/2004 | Panfili et al. | |
| 6,742,215 | B2 | 6/2004 | Panfili et al. | |
| 6,769,147 | B1 | 8/2004 | Stubbs | |
| 6,775,912 | B2 | 8/2004 | Panfili et al. | |
| 6,959,494 | B2 * | 11/2005 | Taylor | 30/159 |
| 6,996,868 | B1 | 2/2006 | Milano et al. | |
| D535,174 | S | 1/2007 | Chen | |
| D541,998 | S | 5/2007 | Panfili et al. | |
| D555,361 | S | 11/2007 | Arvinte | |
| D555,362 | S | 11/2007 | Arvinte | |
| D555,363 | S | 11/2007 | Arvinte | |
| D569,215 | S | 5/2008 | Chiu | |
| 2005/0279194 | A1 | 12/2005 | Chen | |
| 2009/0313765 | A1 | 12/2009 | Krudo | |

* cited by examiner

SCREW BIT PUTTY KNIFE

CROSS REFERENCE TO RELATED APPLICATIONS

This application is a Continuation-in-Part of U.S. application Ser. No. 11/999,258, filed Dec. 3, 2007, which claims the benefit of U.S. Provisional Application Ser. No. 60/861,973, filed Dec. 1, 2006. The contents of these priority applications are incorporated into the present disclosure by reference and in their entireties.

FIELD OF THE INVENTION

The present invention relates to a utility tool. More particularly, in its intended preferred use, the present invention relates to a utility tool (e.g. a putty knife) having an improved tool handle, that is, with an integrated and retractable screw bit assembly, for screwing purposes in drywall applications and the like, designed also for carrying out various other related multitask functions.

BACKGROUND OF THE INVENTION

Known in the art are various utility tools used for drywall applications and the like, such as putty knives, screwdrivers, etc.

For example, U.S. Pat. No. 2,092,586 granted on Sep. 7, 1937, to NAUMOVICH relates to a screw driver. There is described an article which is characterized by a flat metallic handle portion adapted to continue into a scraper blade, and a screw driver pivotally mounted on the rear end of said handle portion and adapted to assume a closed position against one side portion of said handle.

U.S. Pat. No. 6,530,098 B1 granted on Mar. 11, 2003, to GRINGER et al. relates to a multiple tool device. There is described a taping knife which includes a continuous shaft having a blade on a first end thereof, and a hammer on a second end thereof. A handle surrounds the shaft with the blade extending from one end thereof, and the hammer extending from the other end thereof. The handle preferably is constructed with a molded inner core and a soft molded rubber overlay. The hammer includes a hammering surface generally perpendicular to a central axis of the handle. The inner core is preferably constructed of a molded thermoplastic, and the overlay is preferably constructed of an injection molded rubber. The handle may include a bit storage slot for receiving and storing a screwdriver bit. The overlay may include a plurality of flexible fingers adjacent to the bit storage slot for securing a screwdriver bit in the slot. The hammer may include a sleeve for receiving a screwdriver bit with a working portion of the bit extending from the sleeve.

Also known to the Applicant are the following US patents, patent application and industrial design which describe various utility tools and the like, some of which contain integrated and retractable screwdriver attachments: U.S. Pat. Nos. 2,810,194; 2,839,110; 3,774,252; 5,063,627; 5,251,352; 5,720,063; 5,870,786; 5,927,164; 6,131,222; 6,272,708 B1; 6,530,098 B1; 6,662,521 B1; 6,769,147 B1; 6,996,868 B1; 2009/0313765 A1; and U.S. Pat. No. D380,661.

It is also known in the art that workers need to use different tools in order to carry out different tasks during drywall applications and the like, and the use of different tools is somewhat disadvantageous in that, namely, time is wasted when going from one tool to another, and that additional space is required for the provision of such various tools in a given tool box, tool belt, etc. Therefore, it would be useful to provide a tool, such as a putty knife for example, which would be devised to carry out several tasks which would normally be done by means of a plurality of different other corresponding tools.

Some of the above-listed documents described utility tools comprise integrated and retractable screw bit mechanisms, but these mechanisms are known to be not optimal in terms of design, ergonomics, multitasking, easy of use and other considerations (ex. torque transfer when screwing fasteners, etc.).

Hence, in light of the aforementioned, there is a need for a utility tool, which by virtue of its design and components, would be able to overcome some of the above-discussed prior art concerns.

SUMMARY OF THE INVENTION

The object of the present invention is to provide a utility tool, which by virtue of its design and components, satisfies some of the above-mentioned needs and is thus an improvement over other related utility tools and/or methods known in the prior art.

In accordance with the present invention, the above object is achieved, as will be easily understood, with a tool handle (and resulting "tool"), such as the one briefly described herein, and such as the one exemplified in the accompanying drawings. Preferably, the resulting tool is a putty knife with integrated and retractable screw bit assembly for drywall applications and the like, as well as being also devised to carry out various other related multitask functions.

More particularly, according to the present invention, there is provided a utility tool comprising:

an elongated handle assembly for manual handling of the utility tool, the handle assembly extending substantially along a longitudinal axis, and having front and rear portions, as well as a peripheral side edge extending between top and bottom gripping surfaces;

a blade having an anchoring portion anchored within the handle assembly and an operating portion extending out from the front portion of the handle assembly, the blade extending along a given plane substantially parallel to a corresponding plane defined by the peripheral side edge;

a screw bit assembly having a screw bit component and a corresponding swiveling support component pivotably mounted onto the handle assembly, the screw bit assembly being operable between a removably fixed non-operating configuration and a removably fixed operating configuration, where in the non-operating configuration, the screw bit component and swiveling support component are nested within a corresponding recess provided on the peripheral side edge of the handle assembly, between the top and bottom gripping surfaces of the handle assembly, and where in the non-operating configuration, the screw bit is drawn out of the recess and securely maintained in a fixed configuration so as to be positioned at a fixed slanted angle with respect to the longitudinal axis of the handle assembly; and a biasing assembly contained within the handle assembly and having a resilient component cooperating with an inner component of the swiveling support component so as to securely maintain the screw bit assembly respectively along its corresponding pair of removably fixed configurations, the resilient component of the biasing assembly and inner component of the swiveling support component being configured for automatically urging the screw bit assembly towards the operating configuration when the swiveling support component is located between an operating position and a transitional position, and the resilient component of the biasing assembly and inner component of the swiveling support component being further configured for automatically urging the screw bit assembly towards the non-operating configuration when the swiveling support component is located between a non-operating position and the transitional position.

According to yet another aspect of the present invention, there is also provided a method of operating the above-mentioned tool handle and/or resulting utility tool.

According to yet another aspect of the present invention, there is also provided a kit with components for assembling the above-mentioned tool handle and/or resulting utility tool.

According to yet another aspect of the present invention, there is also provided a set of components for interchanging with components of the above-mentioned tool handle and/or resulting utility tool.

According to yet another aspect of the present invention, there is also provided a method of assembling components of the above-mentioned kit and/or set.

According to another aspect of the present invention, there is also provided a method of manufacturing the above-mentioned tool handle and/or resulting utility tool.

According to another aspect of the present invention, there is also provided a wall surface having been treated with the above-mentioned tool handle and/or resulting utility tool.

The objects, advantages and other features of the present invention will become more apparent upon reading of the following non-restrictive description of preferred embodiments thereof, given for the purpose of exemplification only, with reference to the accompanying drawings.

DETAILED DESCRIPTION OF PREFERRED EMBODIMENTS OF THE INVENTION

Figure 1:
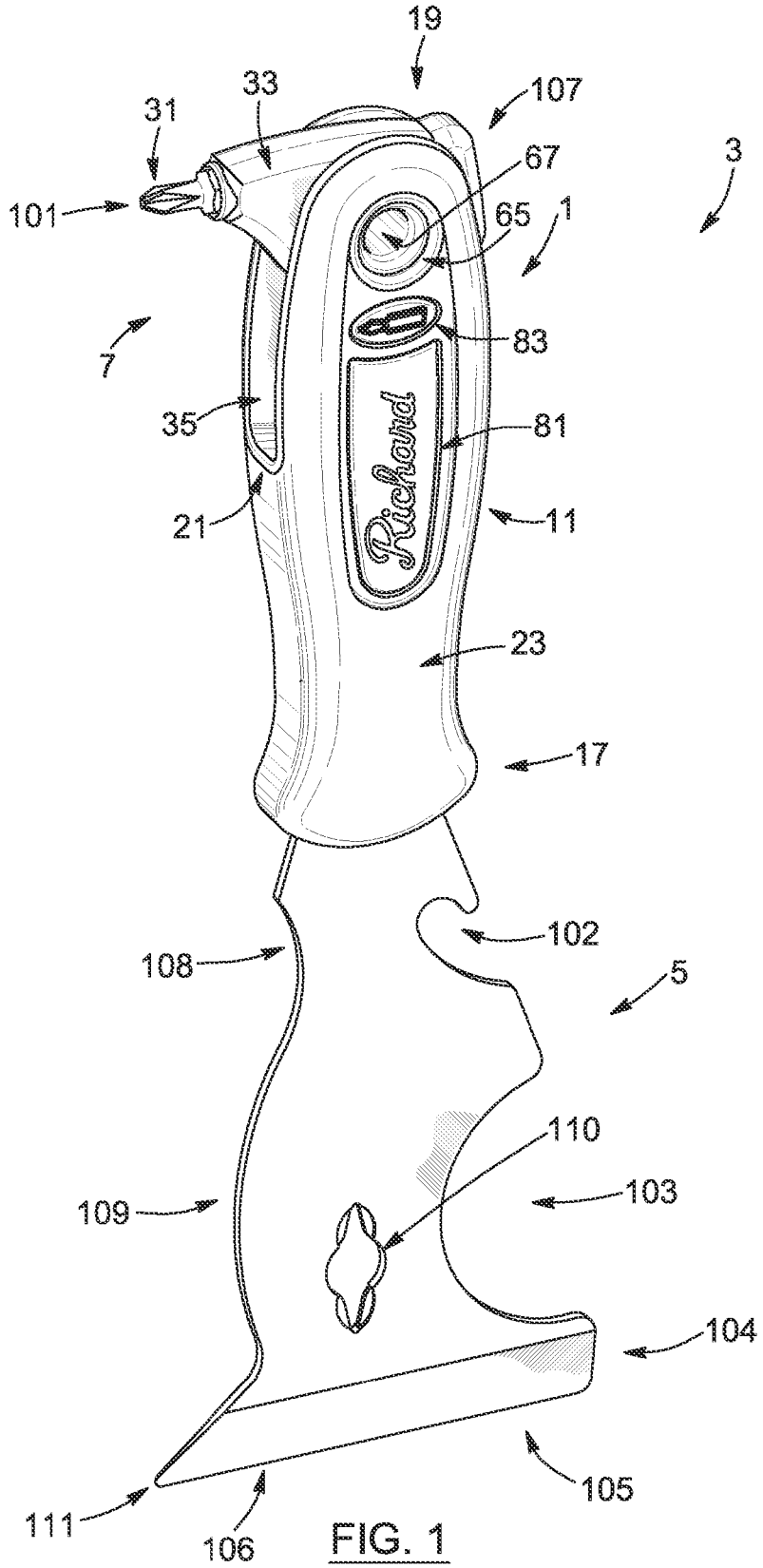
FIG. 1 is a perspective view of a utility tool according to a preferred embodiment of the present invention, the tool being shown with the screw bit assembly in an operating configuration ("opened configuration").

In the following description, the same numerical references refer to similar elements. The embodiments, geometrical configurations, materials mentioned and/or dimensions shown in the figures are preferred, for exemplification purposes only.

Moreover, although the present invention was primarily designed for drywall applications, as well as carrying out other functions related thereto (e.g. plastering, scraping, screwing, tapping, etc.), it may be used with other types of materials and objects and in other fields, as apparent to a person skilled in the art. For this reason, expressions such as "drywall", "tool", "putty", "knife", "scraper", "spatula", etc., as used herein should not be taken as to limit the scope of the present invention and includes all other kinds of objects, materials and/or purposes with which the present invention could be used and may be useful.

Moreover, in the context of the present invention, the expressions "putty knife", "scraper", "spatula", "tool", "device", "unit", "apparatus", and any other equivalent expression known in the art will be used interchangeably. Furthermore, the same applies for any other mutually equivalent expressions, such as "drywall", "wall" and "surface", as well as "tool handle" and "tool" for example, as also apparent to a person skilled in the art.

In addition, although the preferred embodiment of the present invention as illustrated in the accompanying drawings comprises various components and although the preferred embodiment of the tool handle 1 and resulting tool 3 (i.e. putty knife) as shown consists of certain geometrical configurations as explained and illustrated herein, not all of these components and geometries are essential to the invention and thus should not be taken in their restrictive sense, i.e. should not be taken as to limit the scope of the present invention. It is to be understood, as also apparent to a person skilled in the art, that other suitable components and cooperations thereinbetween, as well as other suitable geometrical configurations may be used for the tool handle 1 and resulting tool 3, and corresponding parts, according to the present invention, as briefly explained herein and as can be easily inferred herefrom by a person skilled in the art, without departing from the scope of the invention.

Broadly described, the tool handle 1 according to the present invention, as shown in the accompanying drawings, is a device which, in its preferred intended use, is an improved tool handle 1, to be appropriately mounted onto a given blade 5 or extremity (i.e. other component), so as to form a resulting utility tool 3, such as, for example, a putty knife, a spatula for joints, a taping knife, and/or the like, said tool handle 1 being preferably provided with a mechanism or assembly 7 of screw bit enabling to fasten or screw fasteners such as screws, and the like, into a given wall surface 9. As can be easily understood when referring to the accompanying drawings, the screw bit assembly 7 is preferably one that is integrated to the tool handle 1, and one that is preferably retractable, so as to be operated preferably between only two (2) configurations, namely an operating (i.e. "opened", "elevated", etc.) configuration and a non-operating (i.e. "closed", "nested", etc.) configuration, although several intermediate configurations could also be provided, as can be easily understood by a person skilled in the art.

According to a preferred embodiment of the present invention, the utility tool 3 comprises an elongated handle assembly 11, a blade 5, a screw bit assembly 7, and a biasing assembly 13, as will be explained in greater detail when referring to the accompanying drawings.

Namely, the handle assembly 11 is used for manual handling of the utility tool 3, the handle assembly 11 extending substantially along a longitudinal axis 15, and having front and rear portions 17,19, as well as a peripheral side edge 21 extending between top and bottom gripping surfaces 23,25.

The blade 5 has an anchoring portion 27 anchored within the handle assembly 11 and an operating portion 29 extending out from the front portion 17 of the handle assembly 11, the blade 5 extending along a given plane substantially parallel to a corresponding plane defined by the peripheral side edge 21.

The screw bit assembly 7 preferably has a screw bit component 31 and a corresponding swiveling support component 33 pivotably mounted onto the handle assembly 11, the screw bit assembly 7 being operable between a removably fixed non-operating configuration and a removably fixed operating configuration, where in the non-operating configuration, the screw bit component 31 and swiveling support component 33 are nested within a corresponding recess 35 provided on the peripheral side edge 21 of the handle assembly 11, between the top and bottom gripping surfaces 23,25 of the handle assembly 11, and where in the non-operating configuration, the screw bit component 31 is drawn out of the recess 35 and securely maintained in a fixed configuration so as to be positioned at a fixed slanted angle θ with respect to the longitudinal axis 15 of the handle assembly 11.

Figures 17, 17A:
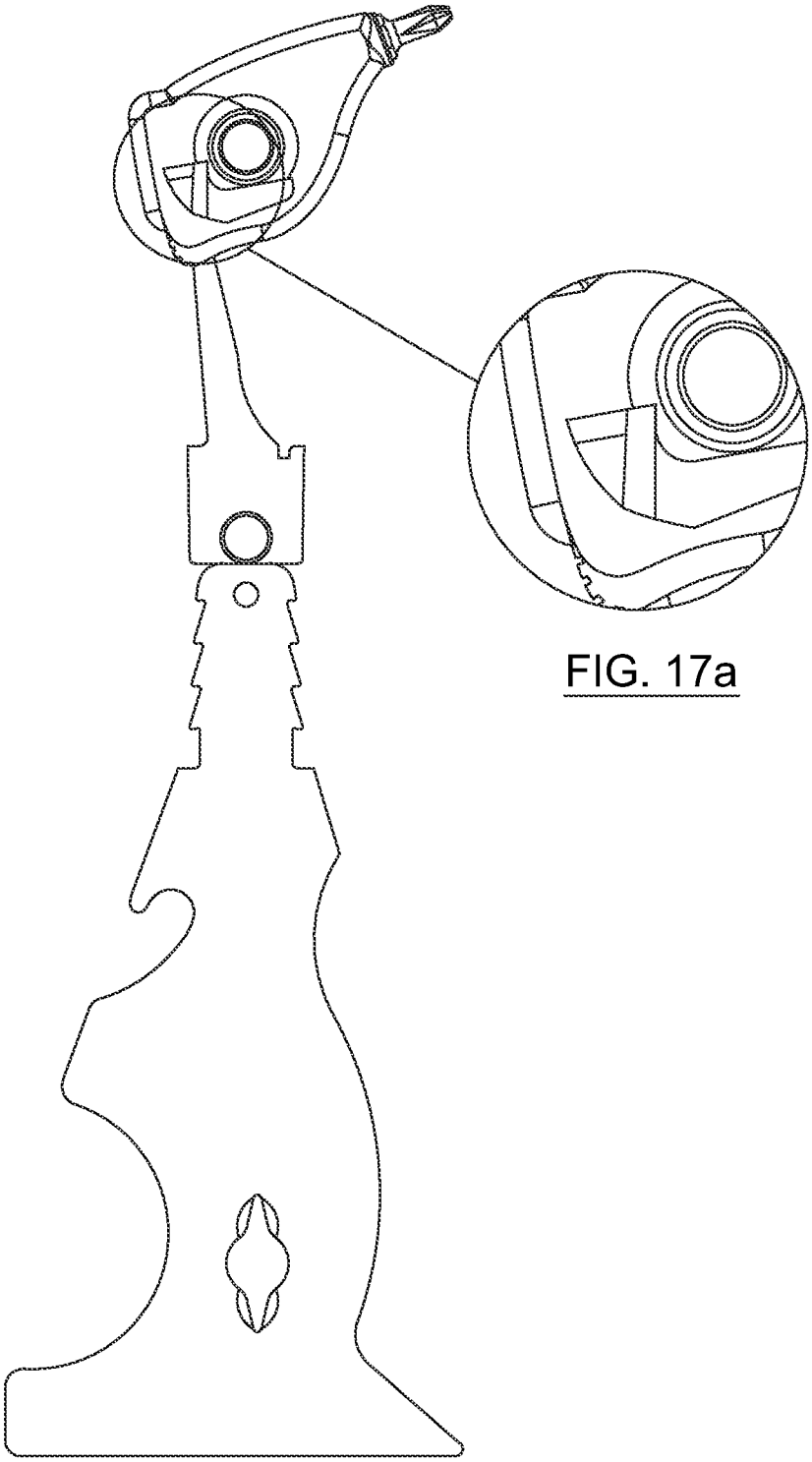
FIG. 17 is a side elevational view of a screw bit assembly, resilient component and blade of the utility tool cooperating with one another according to a preferred embodiment of the present invention, the screw bit assembly being shown in an operating configuration ("opened configuration").
FIG. 17*a* is an enlarged view of a portion of what is shown in FIG. 17.
Figures 18, 18A:
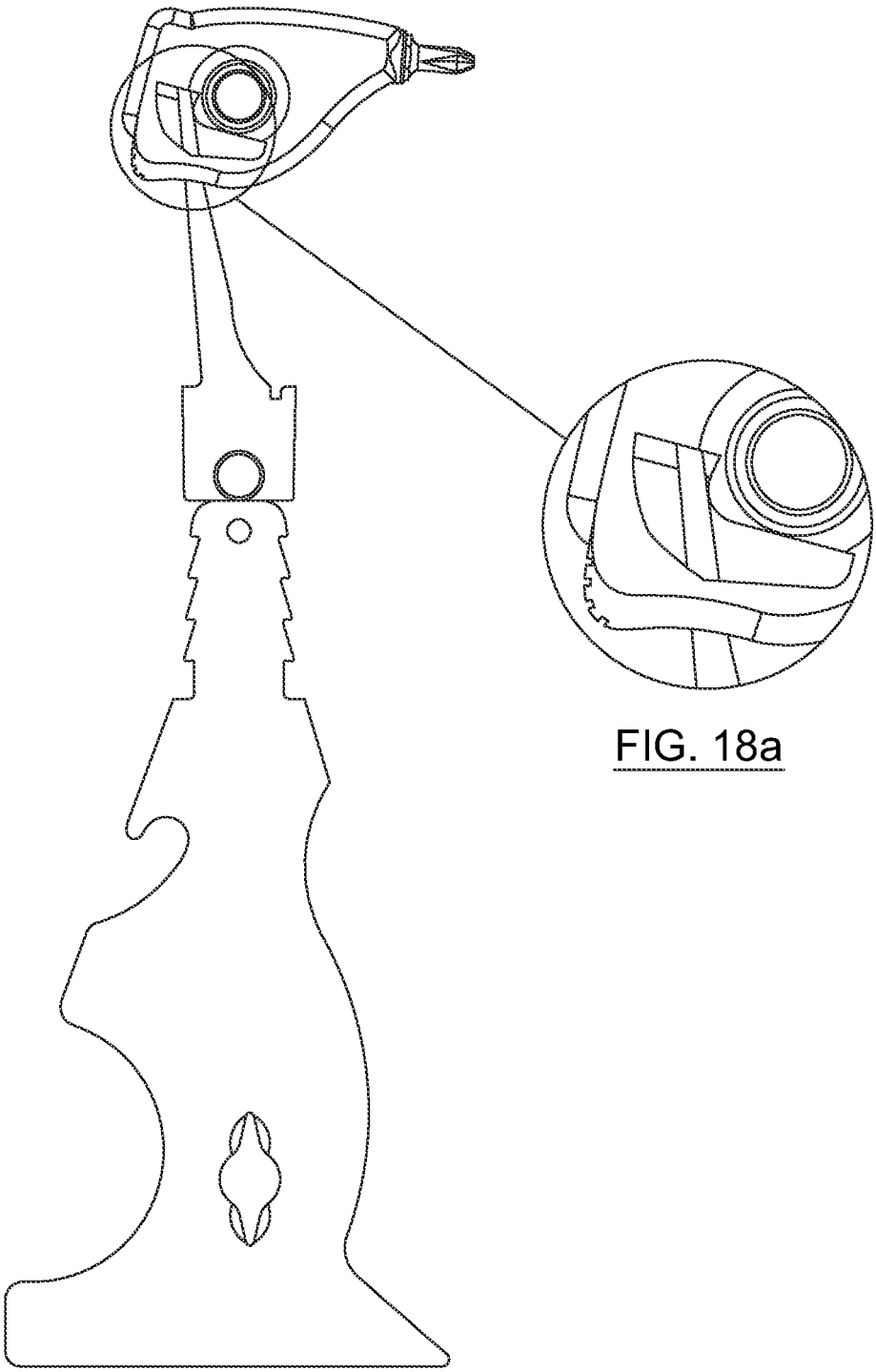
FIG. 18 is another side elevational view of what is shown in FIG. 17, the screw bit assembly being now shown in an upper intermediate configuration.
FIG. 18*a* is an enlarged view of a portion of what is shown in FIG. 18.
Figures 19, 19A:
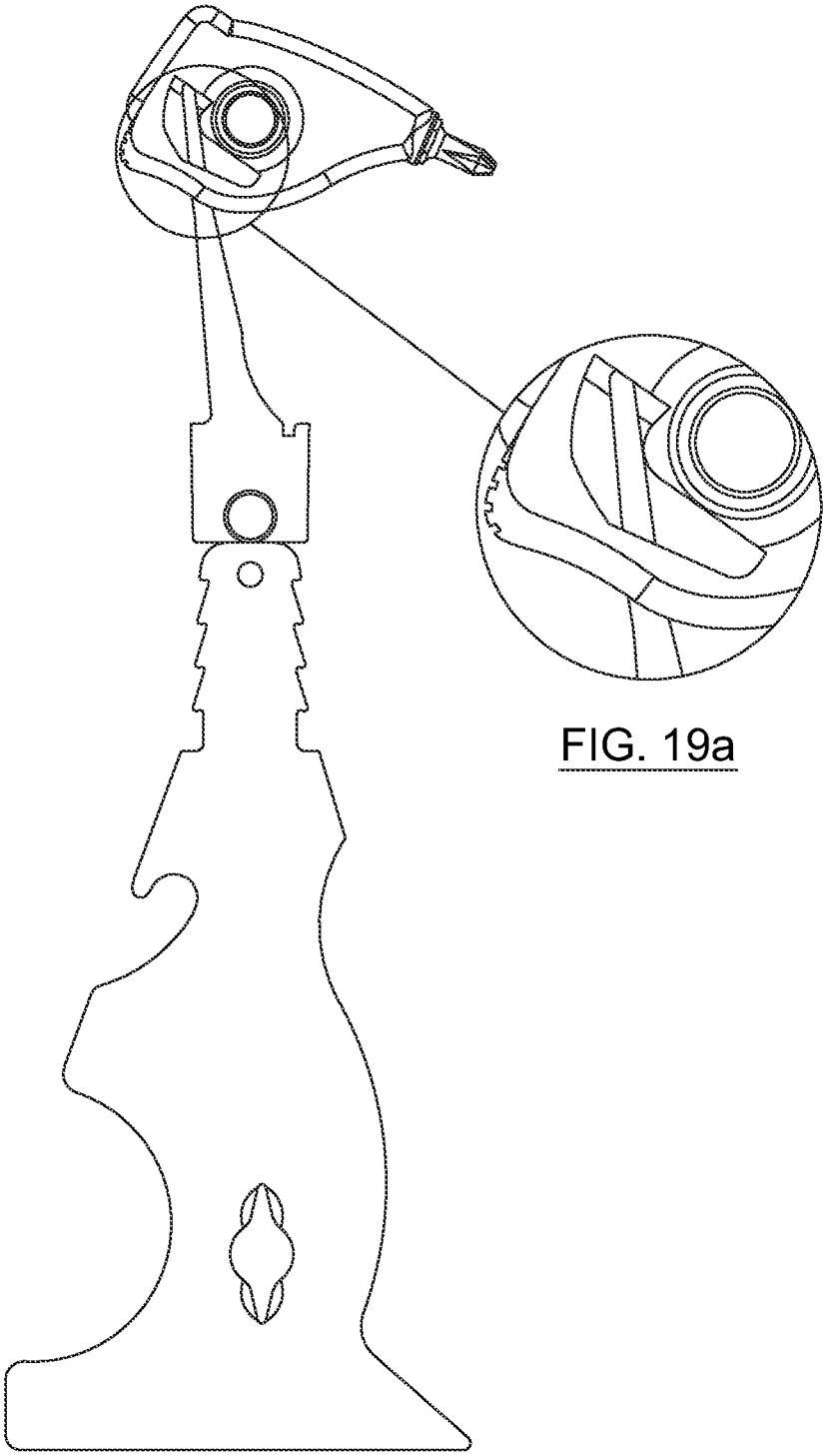
FIG. 19 is another side elevational view of what is shown in FIG. 18, the screw bit assembly being now shown in a transitional configuration.
FIG. 19*a* is an enlarged view of a portion of what is shown in FIG. 19.
Figures 20, 20A:
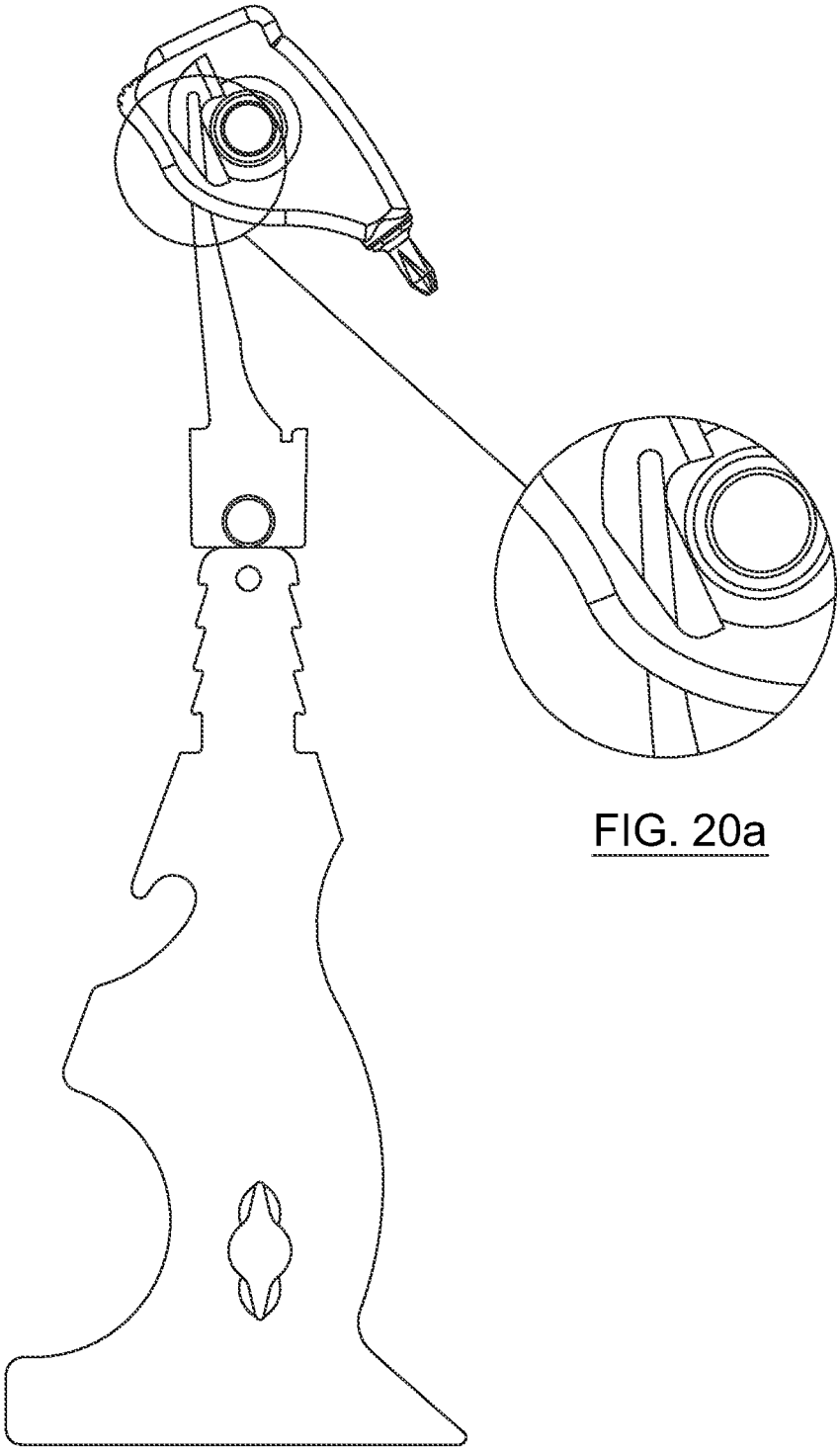
FIG. 20 is another side elevational view of what is shown in FIG. 19, the screw bit assembly being now shown in a lower intermediate configuration.
FIG. 20*a* is an enlarged view of a portion of what is shown in FIG. 20.
Figures 21, 21A:
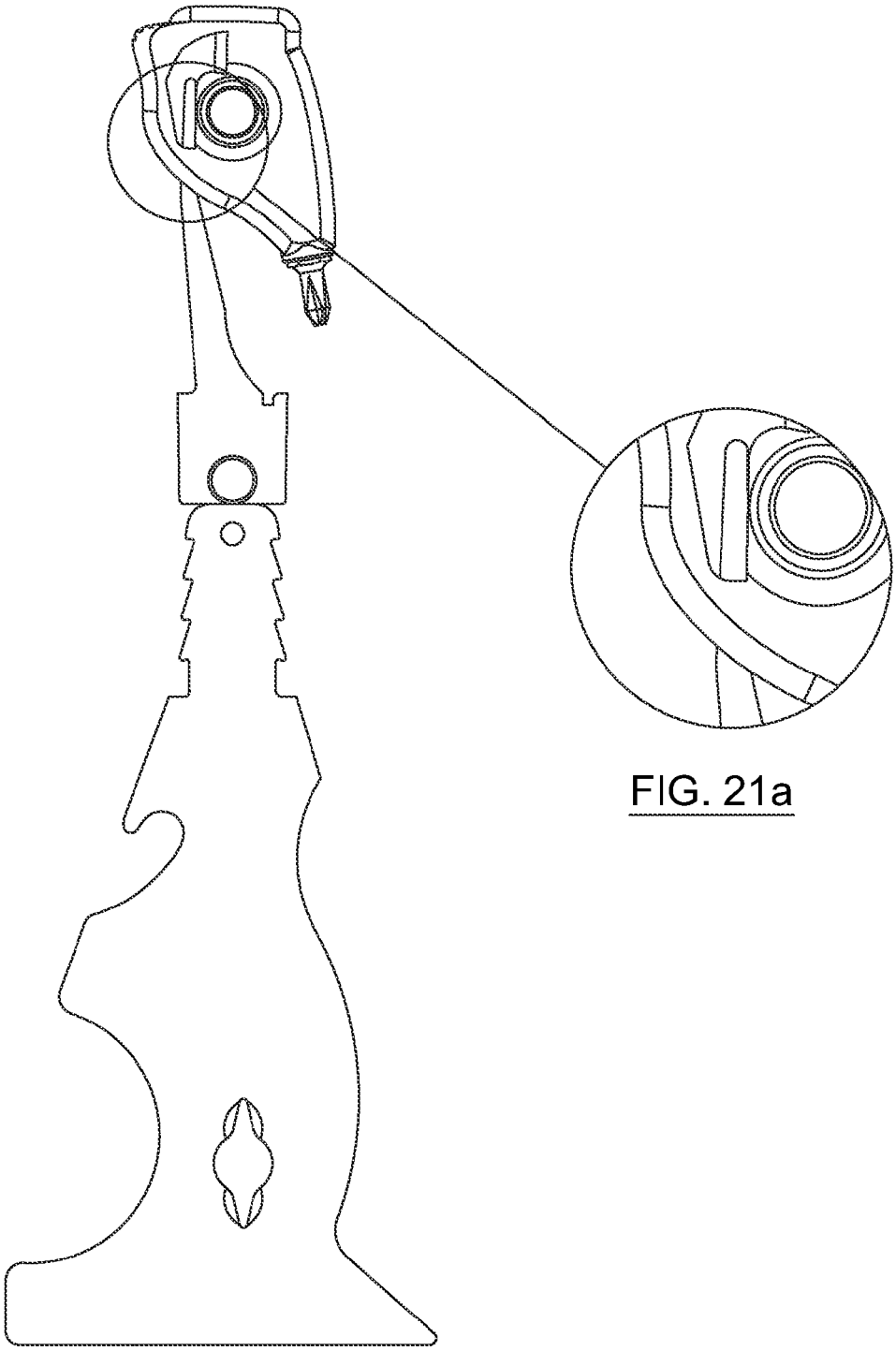
FIG. 21 is another side elevational view of what is shown in FIG. 20, the screw bit assembly being now shown in a non-operating configuration ("closed configuration").
FIG. 21*a* is an enlarged view of a portion of what is shown in FIG. 21.
Figure 22:
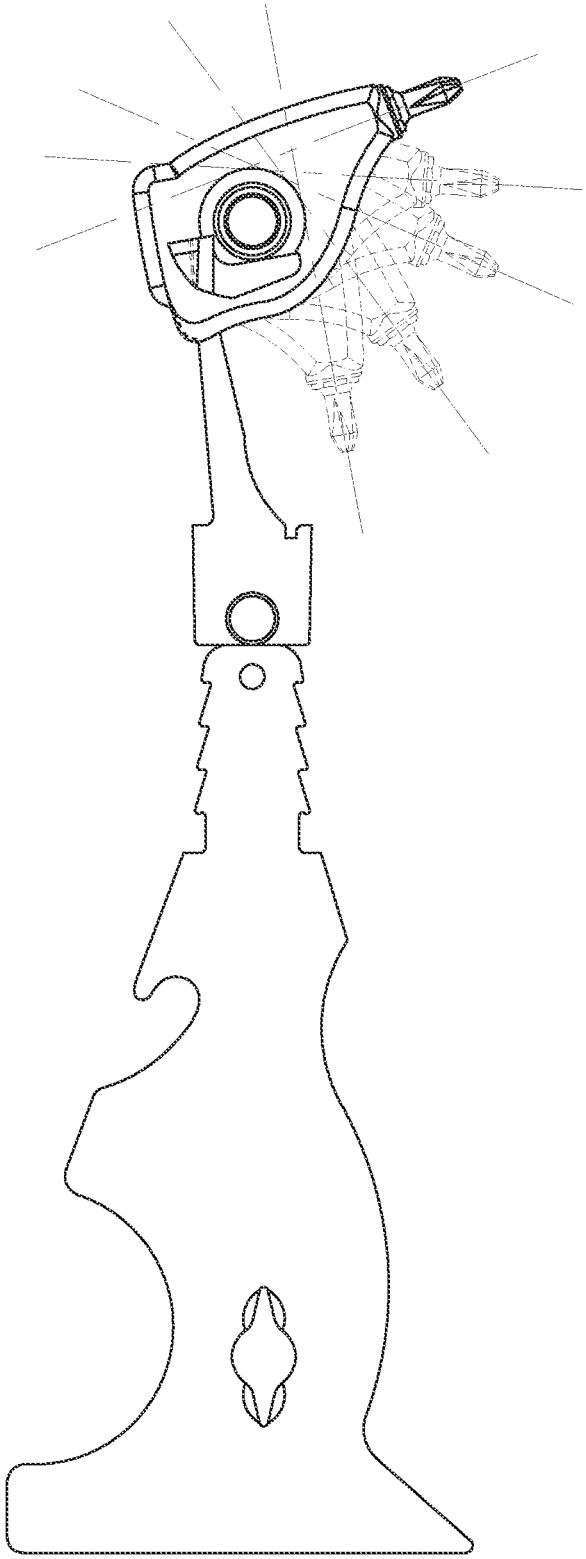
FIG. 22 is another side elevational view of what is shown in FIG. 17, wherein intermediate, transitional and non-operating configurations of the screw bit assembly are contrasted in stipple lines.

The biasing assembly 13 is preferably contained within the handle assembly 11 and has a resilient component 37 cooperating with an inner component 39 of the swiveling support component 33 so as to securely maintain the screw bit assembly 7 respectively along its corresponding pair of removably fixed configurations, the resilient component 37 of the biasing assembly 13 and inner component 39 of the swiveling support component 33 being configured for automatically urging the screw bit assembly 7 towards the operating configuration when the swiveling support component 33 is located between an operating position and a transitional position (see FIGS. 18 and 18*a*, for example, illustrating an upper intermediate position of the swiveling support component 33—as a result of this intermediate configuration, the screw bit assembly 7 will automatically be urged back via the biasing assembly 13 to the operating configuration, the latter being better shown in FIGS. 17 and 17*a*), and the resilient component 37 of the biasing assembly 13 and inner component 39 of the swiveling support component 33 being further configured for automatically urging the screw bit assembly 7 towards the non-operating configuration when the swiveling support component 33 is located between a non-operating position and the transitional position (see FIGS. 20 and 20*a*, for example, illustrating a lower intermediate position of the swiveling support component 33—as a result of this intermediate configuration, the screw bit assembly 7 will automatically be urged back via the biasing assembly 13 to the non-operating configuration, the latter being better shown in FIGS. 21 and 21*a*), as can be easily understood by a person skilled in the art.

According to a preferred embodiment of the present invention, and as better shown in FIGS. 13-22, the inner component 39 of the swiveling support component 33 preferably comprises a cam-shaped component 41, and the resilient component 37 of the biasing assembly 13 comprises top and bottom ends 43,45, the bottom end 45 being securely anchored to the handle assembly 11 and the top end 43 being tapered with respect to the bottom end 45 and being also resiliently displaceable within a given range, the top end 43 of the resilient component 37 pushing against the cam-shaped component 41 for automatically urging the screw bit assembly 7 towards the operating configuration when the swiveling support component 33 is located between the operating position and the transitional position, and for automatically urging also the screw bit assembly 7 towards the non-operating configuration when the swiveling support component 33 is located between the non-operating position and the transitional position.

Preferably also, swiveling support component 33 of the screw bit assembly 7 comprises an inner channel 47 for receiving the top end 43 of the resilient component 37, said inner channel 47 being positioned, shaped and sized within the swiveling support component 33 for allowing resilient displacements of the top end 43 of the resilient member 37 within the inner channel 47 and against the cam-shaped component 41 when the swiveling support component 33 is operated between its operating and non-operating positions.

As better shown in FIGS. 13-22, the inner channel 47 is defined between a pair of lateral surfaces 49 of the swiveling support component 33, and wherein the entry 51 to the inner channel 47 is provided on a bottom portion of the swiveling support component 33.

The swiveling support component 33 is preferably provided with a flat end 53 positioned, shaped and sized to carry out the function of a nailing cap 55 when the screw bit assembly 7 is in the non-operating configuration, and according to a preferred embodiment of the present invention, the flat end 53 is provided on the swiveling support component 33, within the same plane defined by the peripheral side edge.

As can also be better easily understood when referring to FIGS. 13-23, the swiveling support component 33 may also be provided with a finger receiving portion 57 for enabling a swiveling of the screw bit assembly 7 into the operating configuration via a pressing action by a corresponding finger of a user of the utility tool onto said finger receiving portion 57, the finger receiving portion 57 being preferably provided adjacent to the entry 51 of the inner channel 47 of the swiveling support component 33, as better shown in FIGS. 13-16.

Preferably also, the finger receiving portion 57 is provided with a series of corresponding transversal ribs 59 for facilitating an improved grip and corresponding activation of the finger receiving portion 57, and the flat end 53 (i.e. nail cap 55) is positioned adjacent to the finger receiving portion 57.

Figure 13:
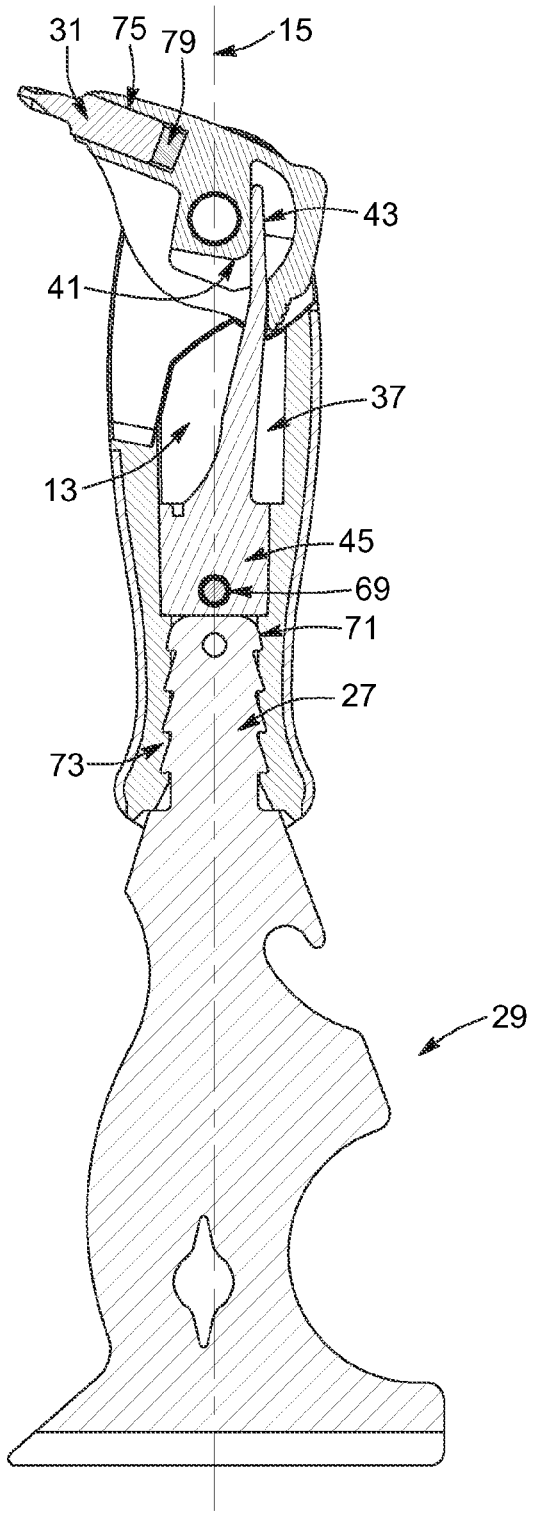
FIG. 13 is a cross-sectional view along a median plane XIII-XIII shown in FIG. 12, so as to better illustrate inner components of the utility tool according to a preferred embodiment of the present invention.
Figure 14:
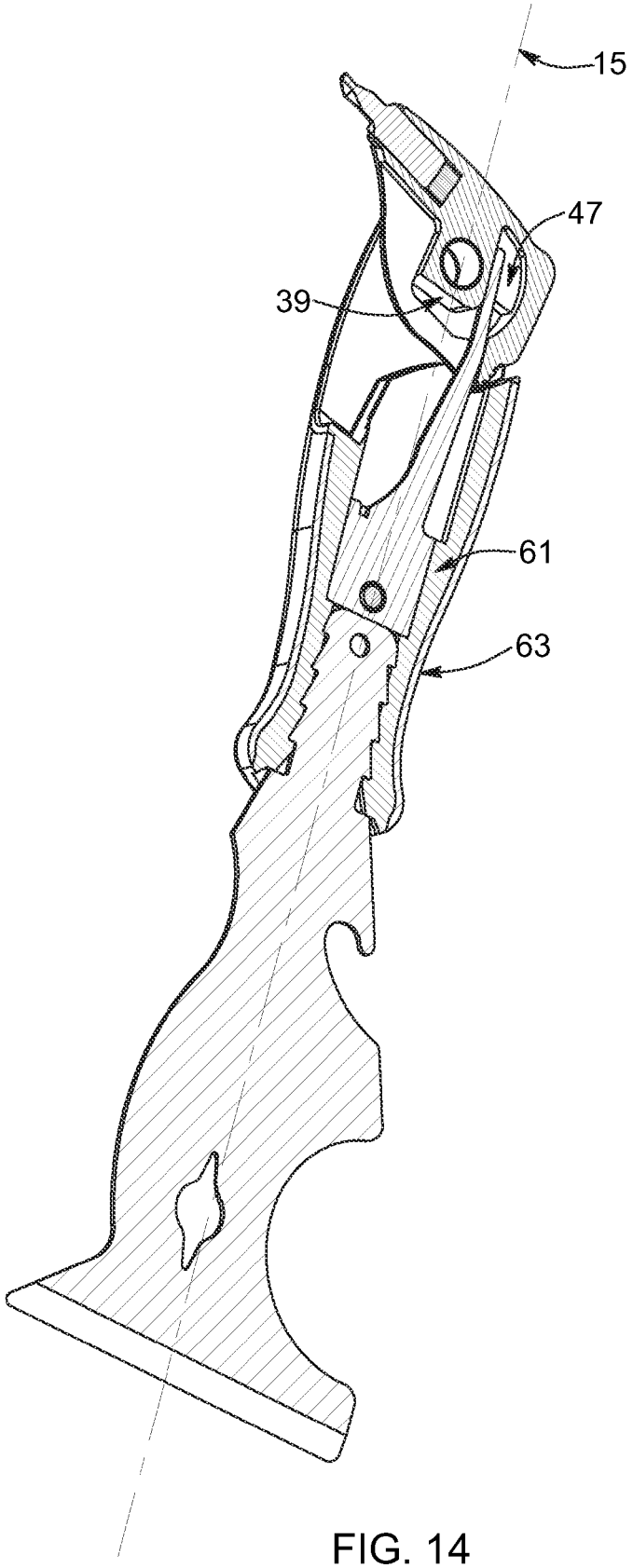
FIG. 14 is a perspective view of what is shown in FIG. 13.
Figure 15:
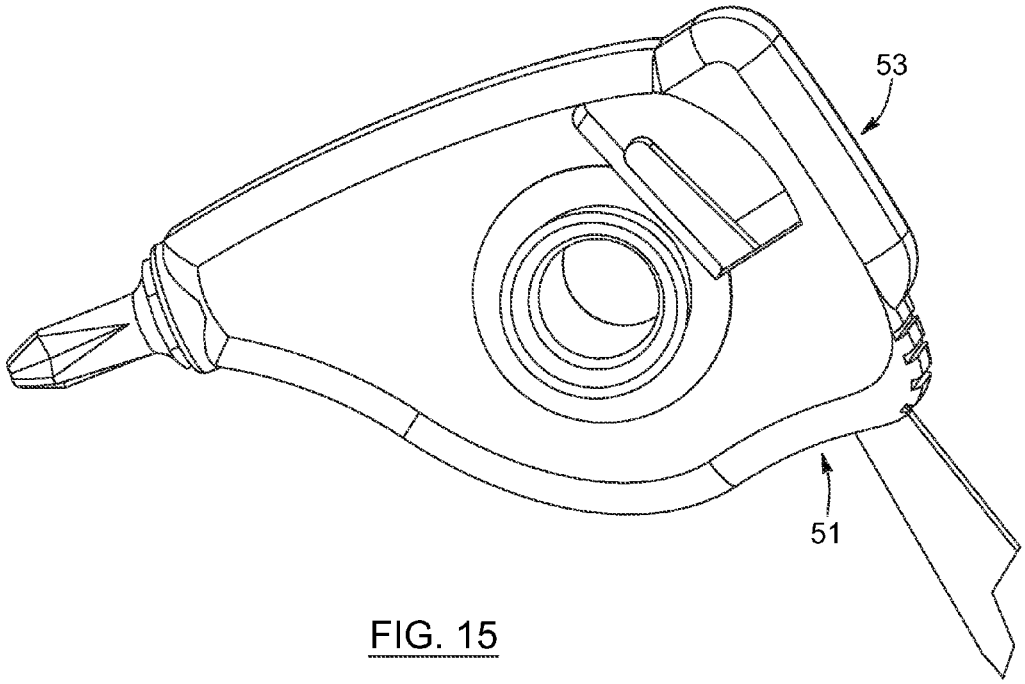
FIG. 15 is a partial perspective view of a screw bit mechanism cooperating with an extremity of a resilient component according to a preferred embodiment of the present invention, the screw bit assembly being shown in an operating configuration ("opened configuration").
Figure 16:
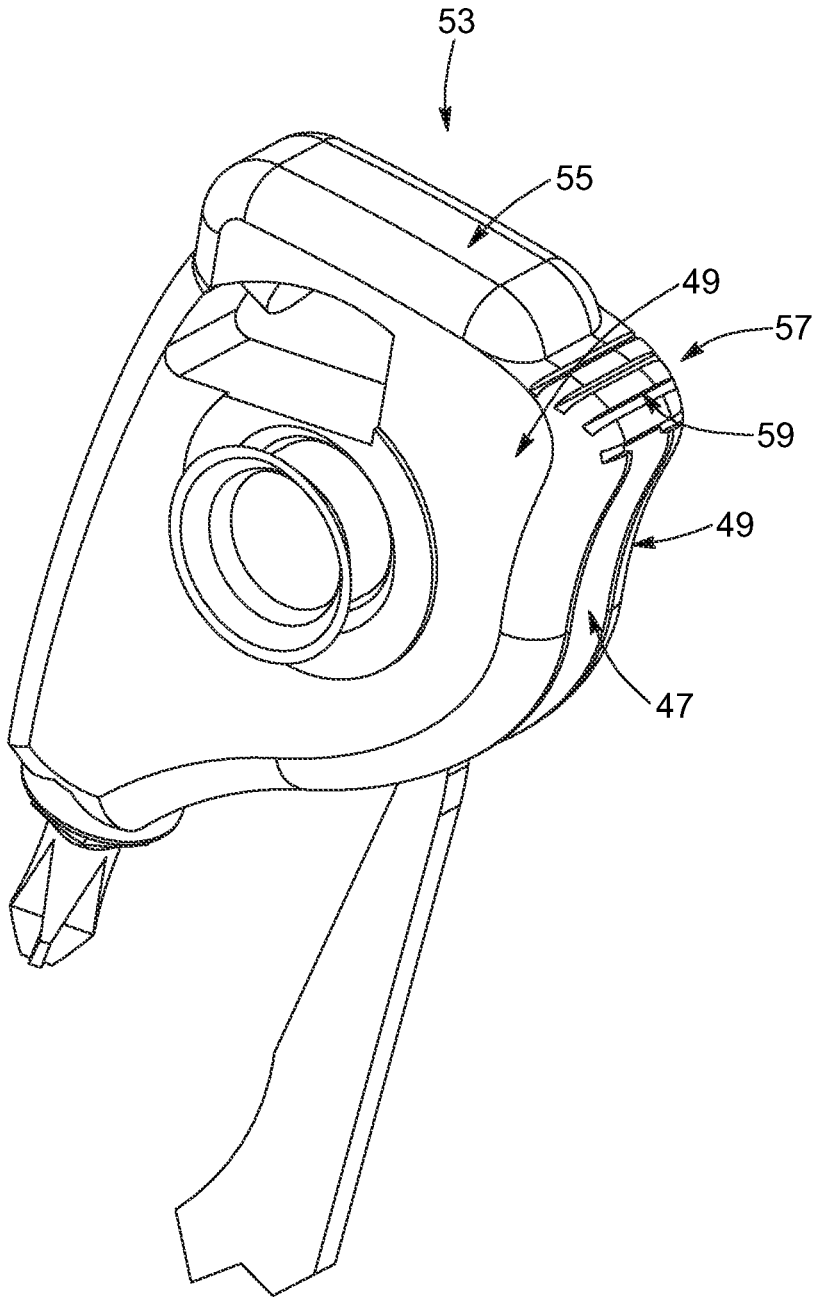
FIG. 16 is another perspective view of what is shown in FIG. 15, the screw bit assembly being now shown in a non-operating configuration ("closed configuration").

As can also be better easily understood when referring to FIGS. 13-14, the handle assembly 15 comprises an inner core 61 made of a substantially rigid material, while comprising corresponding overlaying portions 63 made of an elastomeric material, for improving manipulation and grip of the handle assembly 11 and of the corresponding utility tool 3, the swiveling support component 33 being pivotably mounted onto the inner core 61, about the rear portion 19 of the handle assembly 11.

Preferably also, swiveling support component 33 is pivotably mounted onto the handle assembly 11 by means of an eyelet 65, the eyelet 65 providing the utility tool with a corresponding bore 67 extending through the handle assembly, from the top gripping surface 23 to the bottom gripping surface 25 thereof, for enabling to hang the utility tool 3 onto a corresponding support structure, as better be easily understood when referring to FIGS. 1-4.

According to a preferred embodiment of the present invention, the bottom end 45 of the resilient component 37 is secured affixed onto the inner core 61 of the handle assembly 11 via appropriate fasteners 69 (ex. rivets, etc.) and abuts against a distal end 71 of the blade 5 inside the inner core 61 of the handle assembly 11. The distal end 71 of the blade 5 is preferably force-fitted into the inner core 61 of the handle assembly 11 via appropriate securing means (ex. fishbone 73, etc.), as can be easily understood when referring to FIGS. 12-14.

Figure 12:
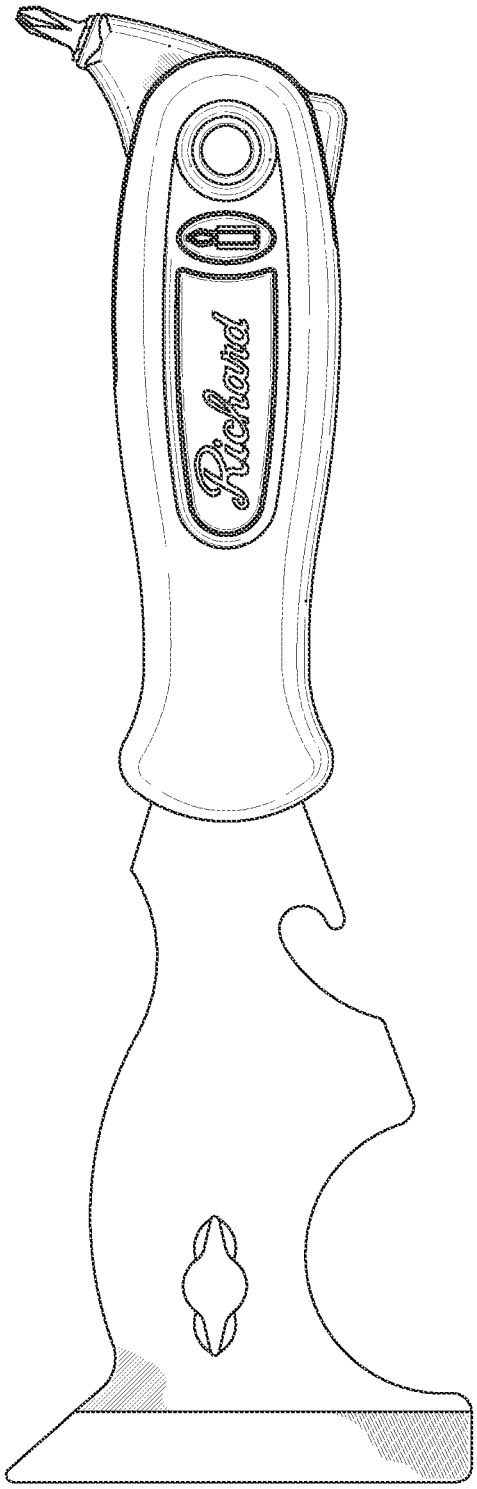
FIG. 12 is a side elevational view of a utility tool according to another preferred embodiment of the present invention, the tool being shown with the screw bit assembly in an operating configuration ("opened configuration").

As also better shown in FIGS. 12-14, the swiveling support component 33 comprises a socket 75 being positioned, shaped and sized for selectively receiving a corresponding screw bit 77 being removably insertable into said socket 75. Preferably, the socket 75 is magnetized with respect to the screw bit 77, such as, for example, with a corresponding magnet component 79, so as to further retain the screw bit 77 within the socket 75. It is worth mentioning also that the handle assembly 11 of the utility tool 3 can be provided with a storing space 81 for storing and allowing an interchangeability of removable screw bits 77 with a corresponding socket 75 of the swiveling support component 33 of the screw bit assembly 7.

Figure 7:
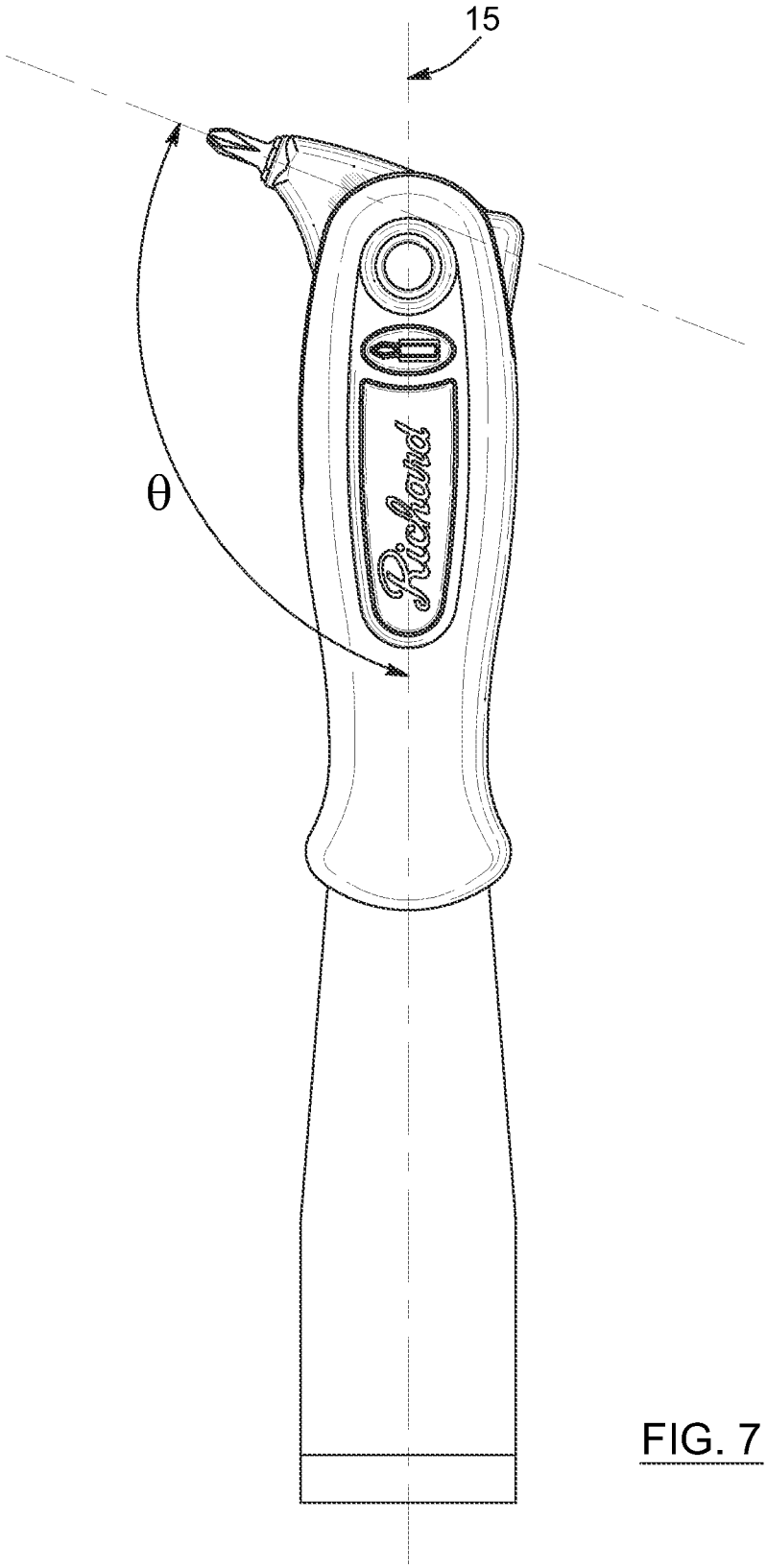
FIG. 7 is a side elevational view of what is shown in FIG. 6.
Figure 8:
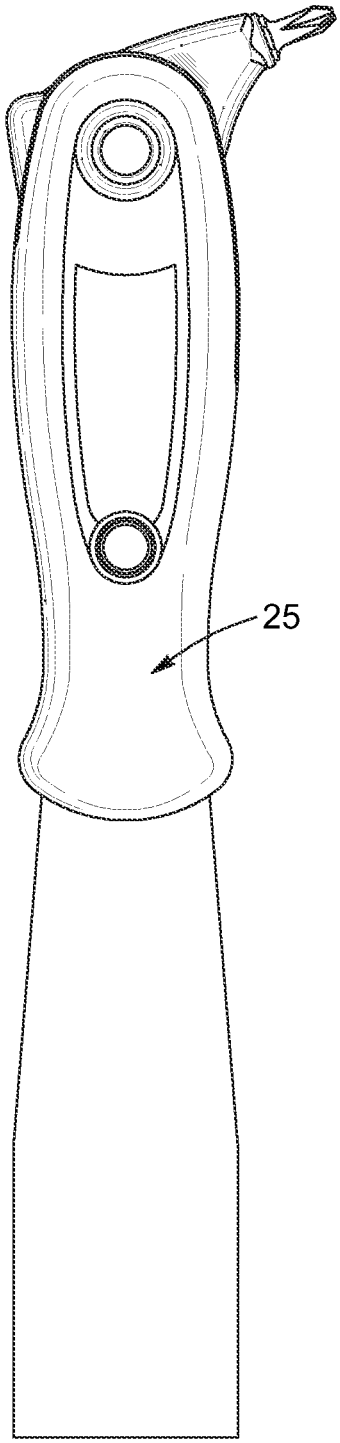
FIG. 8 is a rear view of what is shown in FIG. 7.
Figure 23:
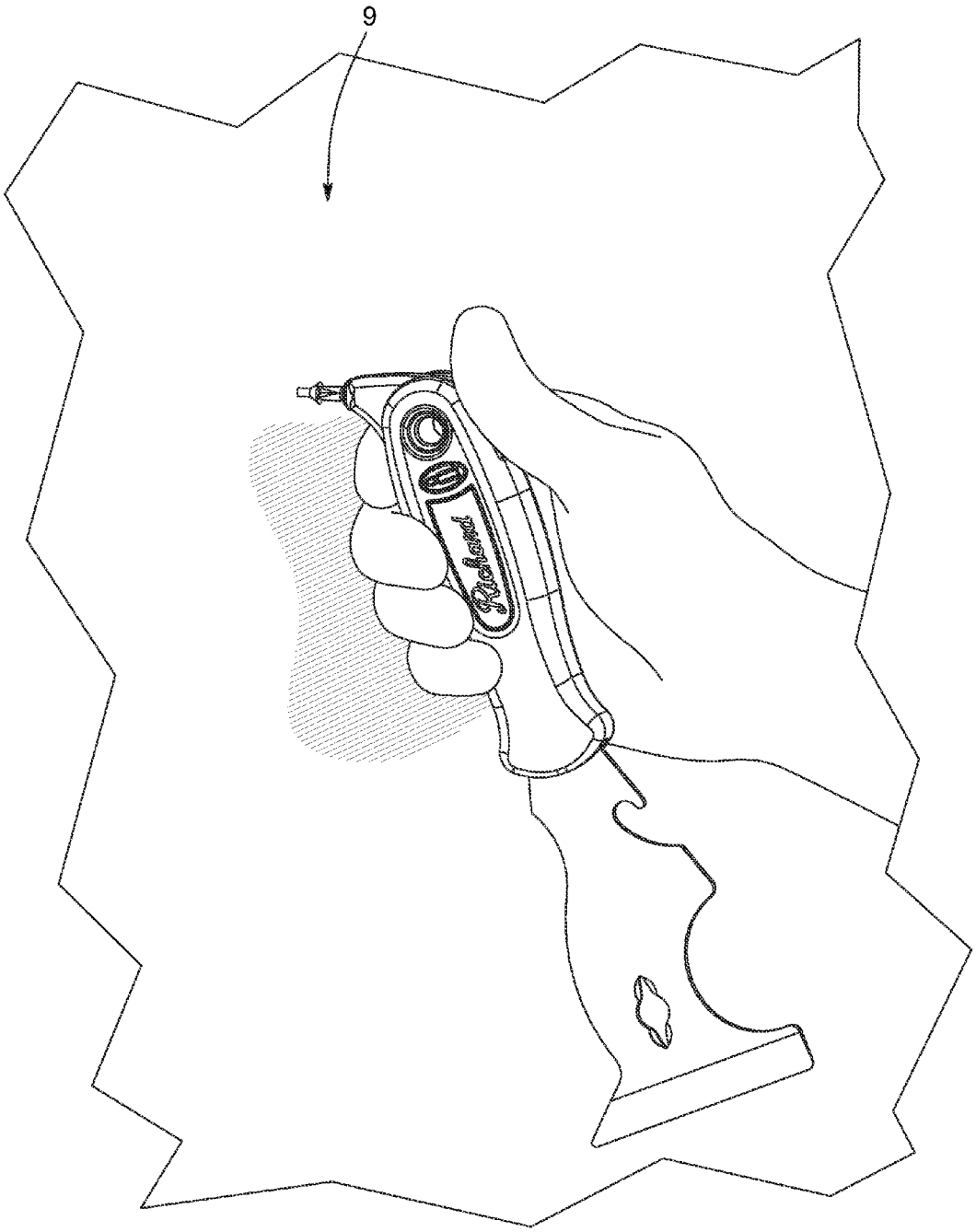
FIG. 23 is partial perspective view of a hand of a user of the utility tool employing the tool on a fastener (ex: screw) provided on a drywall working surface according to a preferred embodiment of the present invention.

As better shown in FIG. 7, and according to a preferred embodiment of the present invention, the slanted angle θ is comprised between about 90 degrees and about 150 degrees with respect to the longitudinal axis 15 of the handle, and the swiveling support component 33 is positioned, shaped and sized so to provide a clearance, between a working surface 9 and the handle assembly 11, for the fingers of a user of the utility tool 3, when the screw bit 77 is substantially perpendicular with respect to the working surface 9, as can be easily understood when referring to FIGS. 23-24. According to a preferred embodiment of the present invention, the slanted angle θ that is securely and automatically maintained via the biasing assembly 13 is about 120 degrees. Indeed, the present utility tool 3 is preferably designed so that the screw bit assembly 7 can only be moved from the operating configuration to the non-operating configuration, and vice-versa, via a "manual override" of the swivel support component 33, either by manually pushing/pulling onto the projecting portion of the swivel support component 33 (or onto the screw bit component 31 thereof), or preferably, by using the finger receiving portion 57, so as to "snap" the screw bit assembly 7 back into a corresponding configuration, otherwise, the swivel support component 33 is preferably meant to always be kept securely maintained in a corresponding configuration (whether "operating" or "non-operating") by means of the biasing force provided by the resilient member 37 of the biasing assembly 13.

It is worth mentioning also that according to another preferred embodiment of the present invention, the screw bit assembly 7 could be configured so as to be triggered via a corresponding activation button 83, the swiveling support component 33 being spring-loaded via another suitable biasing assembly 13, so that upon activation of the activation button 83, the swiveling support component 33 and corresponding screw bit component 31 are automatically elevated via the action of the spring load into the operating configuration, for a "quick-release", as can be easily understood by a person skilled in the art.

Figure 9:
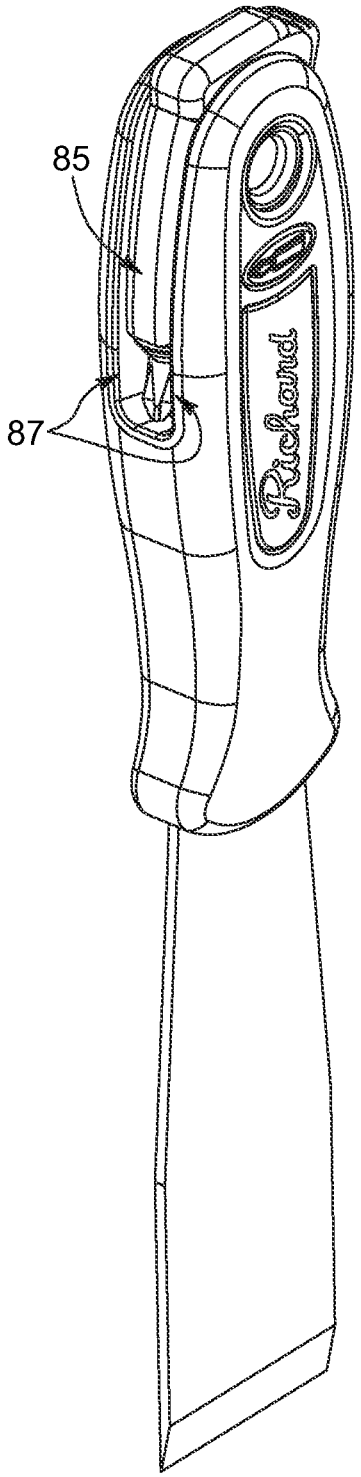
FIG. 9 is another perspective view of what is shown in FIG. 6, the tool being now shown with its screw bit in a non-operating configuration ("closed configuration").
Figure 10:
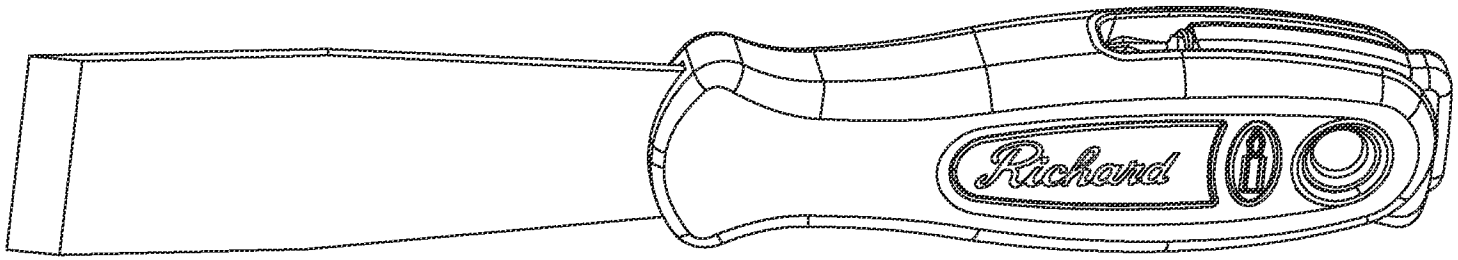
FIG. 10 is another perspective view of what is shown in FIG. 9.
Figure 11:
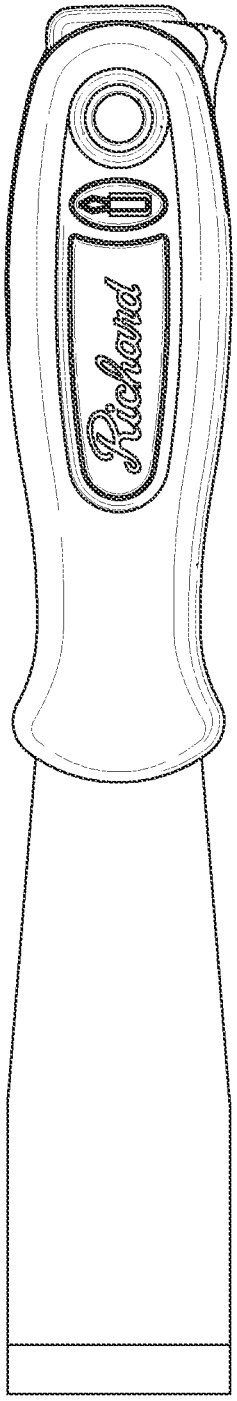
FIG. 11 is a side elevational view of what is shown in FIG. 11.

According to a preferred embodiment of the present invention, and as can be easily understood when referring to FIGS. 9-11, an outer contour 85 of the swiveling support component 33 is complementary in shape with respect to a rim 87 of the recess 35 of the peripheral side edge 21, when the swiveling support component 33 and corresponding screw bit component 31 are nested within the recess 35, so that, among other advantages, an almost "seamless" handle assembly 11 is ergonomically provided when the utility tool 3 is used and when the swiveling support component 33 is the non-operating configuration. Indeed, it may be appreciated that when in such a configuration, in addition to being kept securely nested in the recess 35 by means of the cooperation between the resilient member 37 and the cam-shaped component 41, the swiveling support component 33 and corresponding screw bit component 31 do not interfere with the gripping surfaces 23,25 of the handle assembly 11.

Figure 2:
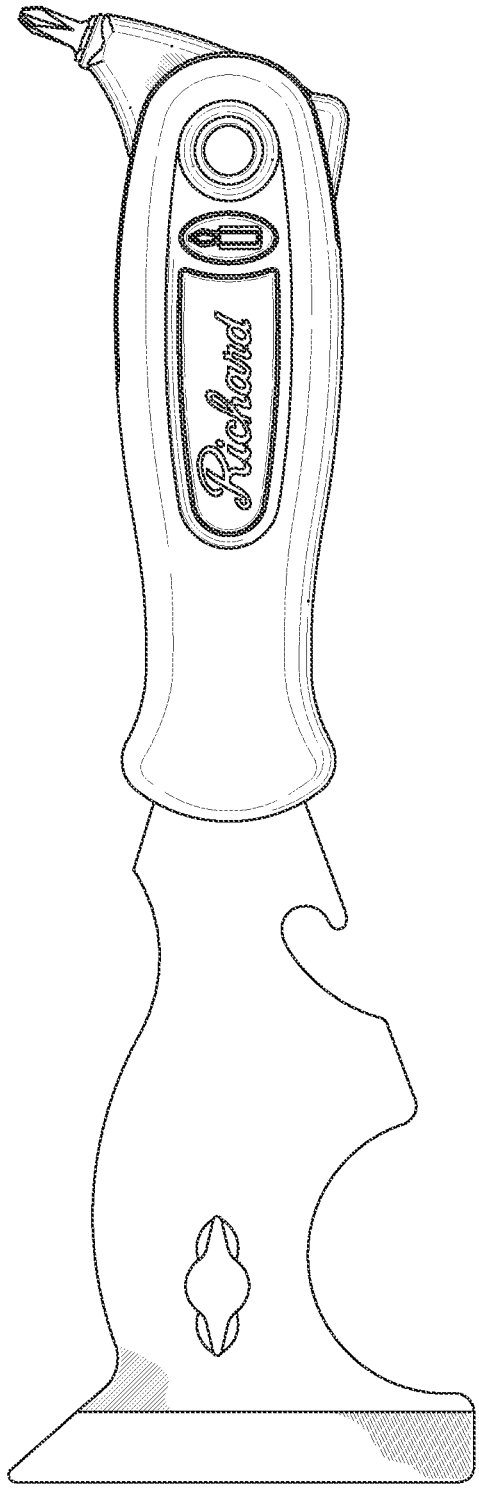
FIG. 2 is side elevational view of what is shown in FIG. 1.
Figure 3:
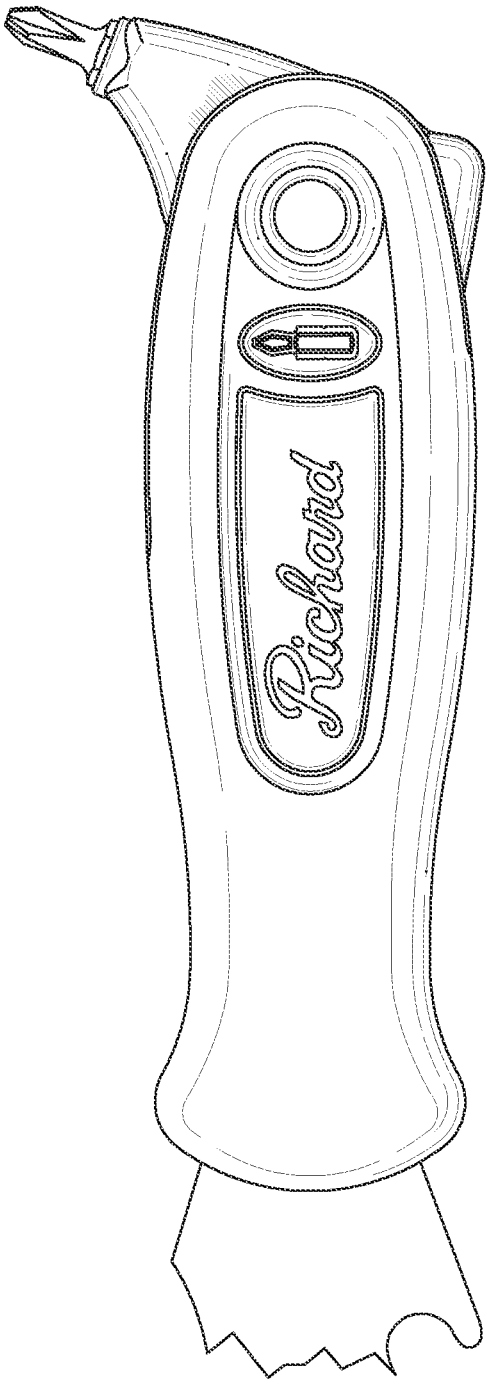
FIG. 3 is an enlarged view of the handle assembly of the utility tool shown in FIG. 2.
Figure 4:
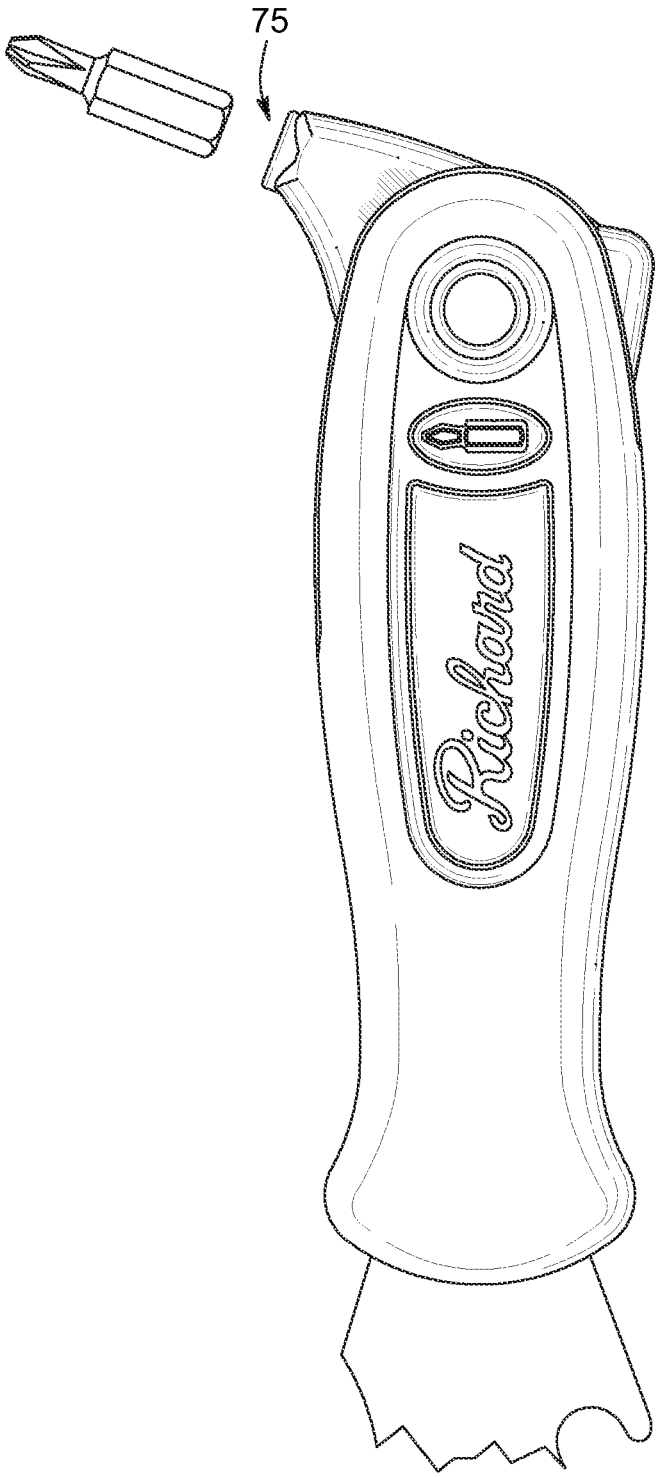
FIG. 4 is another view of what is shown in FIG. 3, the handle assembly being now shown with the screw bit removed from the screw bit assembly.
Figure 5:
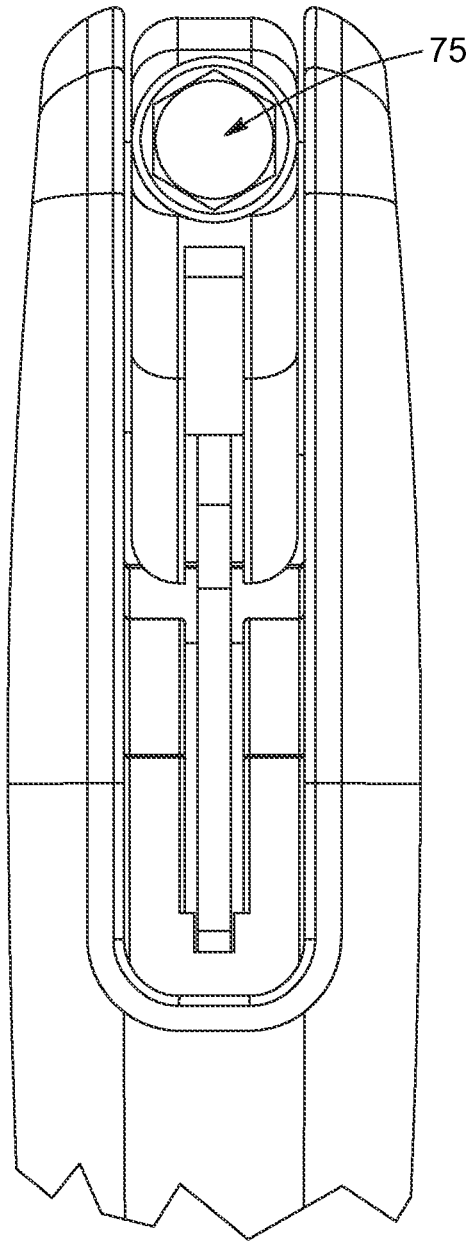
FIG. 5 is an enlarged front view of an inside portion of the handle assembly shown in FIG. 4 with the screw bit assembly illustrated in the operating configuration without its screw bit.

According to a preferred embodiment of the present invention, and as better shown in FIGS. 1 and 2, the utility tool 3 is preferably a 11-in-1 tool, and comprises a first component 101 for setting drywall screws, a second component 102 for opening containers, a third component 103 for cleaning paint rollers, a fourth component 104 for opening paint cans, a fifth component 105 for spreading drywall compound, a sixth component 106 for scraping, a seventh component 107 for closing paint cans, an eight component 108 for scraping concave surfaces, a ninth component 109 for scraping convex surfaces, a tenth component 110 for pulling nails, and an eleventh component 111 for cleaning out cracks.

As previously explained, the utility tool 3 includes an elongated handle 1 for manual handling of the utility tool 3, a blade 5 and a screw bit assembly 7 (hereinafter referred to also as a screw bit "mechanism"). The handle 1 extends substantially along a longitudinal axis 15, and has front and rear portions. The blade 5 has an anchoring portion anchored within the handle 1 and an operating portion extending out from the front portion of the handle 1. The screw bit mechanism 7 is rotatably mounted about the rear portion of the handle 1, has a screw bit 31, and is operable between a non-operating configuration where the screw bit 31 is nested within the handle 1, and an operating configuration where the screw bit 31 is drawn out of the handle 1 and securely maintained in a fixed configuration so as to be positioned at a slanted angle ⊖ with respect to the longitudinal axis 15 of the handle 1, as can be easily understood when contrasting FIGS. 7 and 11, for example. Preferably, the slanted angle ⊖ is comprised between about 90 degrees and about 180 degrees with respect to the longitudinal axis 15 of the handle 1, as also shown, and this provides substantial advantages, as will be described in greater detail hereinbelow.

As can also be easily understood by a person skilled in the art when referring to the accompanying drawings, the tool handle 1 is preferably securely affixed to a given blade 5, or other component, so as to form the resulting tool 3. The tool handle 1 preferably comprises an inner core 61 made of a substantially rigid material, such as a proper plastic or the like, while being provided with corresponding overlaying portions 63 preferably made of a more soft material, such as an elastomeric material, for improving manipulation and grip of the tool handle 1 and resulting tool 3. As previously explained, the tool 3 is preferably provided with a screw bit mechanism 7 being configured preferably so as to be rotatably activated between retracted and operating configurations, the screw bit mechanism 7 being provided with a least one finger receiving portion 57 for enabling a comfortable and ergonomic activation of the screw bit mechanism 7 via a corresponding finger of the hand of the user of the tool 3 according to the present invention. The finger receiving portion 57 preferably comprises a protuberance extending beyond a peripheral layout of the tool handle 1, preferably at a rear portion of the tool handle 1, as better shown in FIG. 1, said protuberance being preferably provided with a series of corresponding transversal ribs 59 for facilitating a better grip of said finger receiving portion 57. The screw bit mechanism 7 preferably comprises a support portion 33 for receiving at least one corresponding screw bit 31 intended to be used for carrying out tasks similar to those of screwdrivers and the like, such as screwing fasteners (screws, etc.) into drywall and other like surfaces. The screw bit mechanism 7 is preferably configured so that its support portion 33 and corresponding screw bit 31 are preferably retracted and lodged within the tool handle 1, as better shown in FIGS. 9-11, when the screw bit mechanism 5 is operated into the retracted configuration.

As can be easily understood by a person skilled in the art when referring to the accompanying drawings, the tool handle 1 as briefly explained herein and exemplified in the accompanying drawings, could be used with a variety of different tools, and thus, the blade 5 or other component used with the tool handle 1 can be various, depending on the particular applications for which the resulting tool 7 is intended for, as also apparent to a person skilled in the art.

Moreover, as also exemplified in the accompanying drawings, the tool handle 1 is preferably provided with a corresponding bore 67 extending through the tool handle 1, for enabling to hang the tool 3 onto a corresponding hook or other suitable support structure, such as a construction belt, and the like. Thus, the screw bit mechanism 7 according to the present invention is preferably configured accordingly, as can be easily understood by a person skilled in the art, so as to enable the provision of such a bore 67 extending to said tool handle 1.

Preferably also, and as exemplified in the accompanying drawings, the tool handle 1 comprises different slanted edges and portions, as well as curved portions, so as to enable for a more comfortable, secured and ergonomic hand grip of the tool handle 1, and thus of the resulting tool 3.

Preferably also, the inner core of the tool handle 1 may be provided with corresponding ribs, flanges, shoulders, and/or recesses, for appropriately receiving the screw bit mechanism 7 and for sustaining the corresponding loads to which the resulting tool 3 and/or handle 1 thereof may be subjected to, as apparent to a person skilled in the art.

Thus, the tool handle 1 and resulting tool 3 according to the present invention preferably comprise an attractive design. As previously explained, the tool handle 1 is preferably provided with an elastomeric and/or rubberized material, to provide for a soft grip ergonomic handle. As also previously explained, the logo and colors used for the handle 1 may be various and interchangeable for allowing the manufacturing of different tools 3 depending on different trademarks used, so as to properly represent the manufacturers, distributors, wholesalers, or other parties involved in the commercialization and selling of the tool 3. As aforementioned, the tool 3 according to the present invention is provided with a novel tool handle 1 provided with an innovative screw bit mechanism 7, preferably intended for gypsum screws and the like, configured to be assembled on any type of blade or other component for assembling the resulting tool 3.

As previously explained, and as illustrated in the accompanying drawings, the screw bit mechanism 7 is preferably intended to be opened or operated with a single hand allowing the user of the present tool 3 to have the other hand free for carrying out other tasks. The screw bit mechanism 7 is also preferably configured so as to be used either by left-hand users or right-hand users, and thus, as can be appreciated from the accompanying drawings, is preferably intended to be substantially symmetrical along a given plane of the tool 3. Furthermore, the opening or activation of the screw bit mechanism 7 can easily be carried out with a corresponding finger of the user, such as a thumb, the index, and/or other. As can also be easily understood by a person skilled in the art, the screw bit mechanism 7 is also preferably provided with resilient means, such as a spring for example, integrated into the screw bit mechanism 7 so as to keep the same, and more particularly the screw bit 31 thereof, in an elevated or extended configuration when operated into the operating configuration. Preferably also, the tool handle 1 according to the present invention is intended to be deprived of any complicated components in the screw bit mechanism 7 enabling for the system to be a simple and reliable one.

Preferably also, the screw bit mechanism 7, in a closed configuration, is provided with a flat end intended preferably to carry out the function of a "nailing cap" so as to namely enable the tapping on nails or other uneven surfaces on the wall surface prior to treatment thereof, with the present tool 3, such as the application of wall compound for covering joints and the like. Preferably also, as exemplified in the accompanying drawings, namely FIGS. 9-11, the screw bit mechanism 7, in the closed configuration, comprises rounded off portions for a greater comfort of a user of the tool handle 1 and resulting tool 3. Preferably also, the screw bit mechanism 7 and the blade 5 reach one another at the center of the tool handle 1 for enabling to transmit the force from the extremity of the blade 5 to the end cap (preferably made of die cast, steel and/or other suitable material) during impacts, as can be easily understood by a person skilled in the art.

Figures 24A, 24B, 24C:
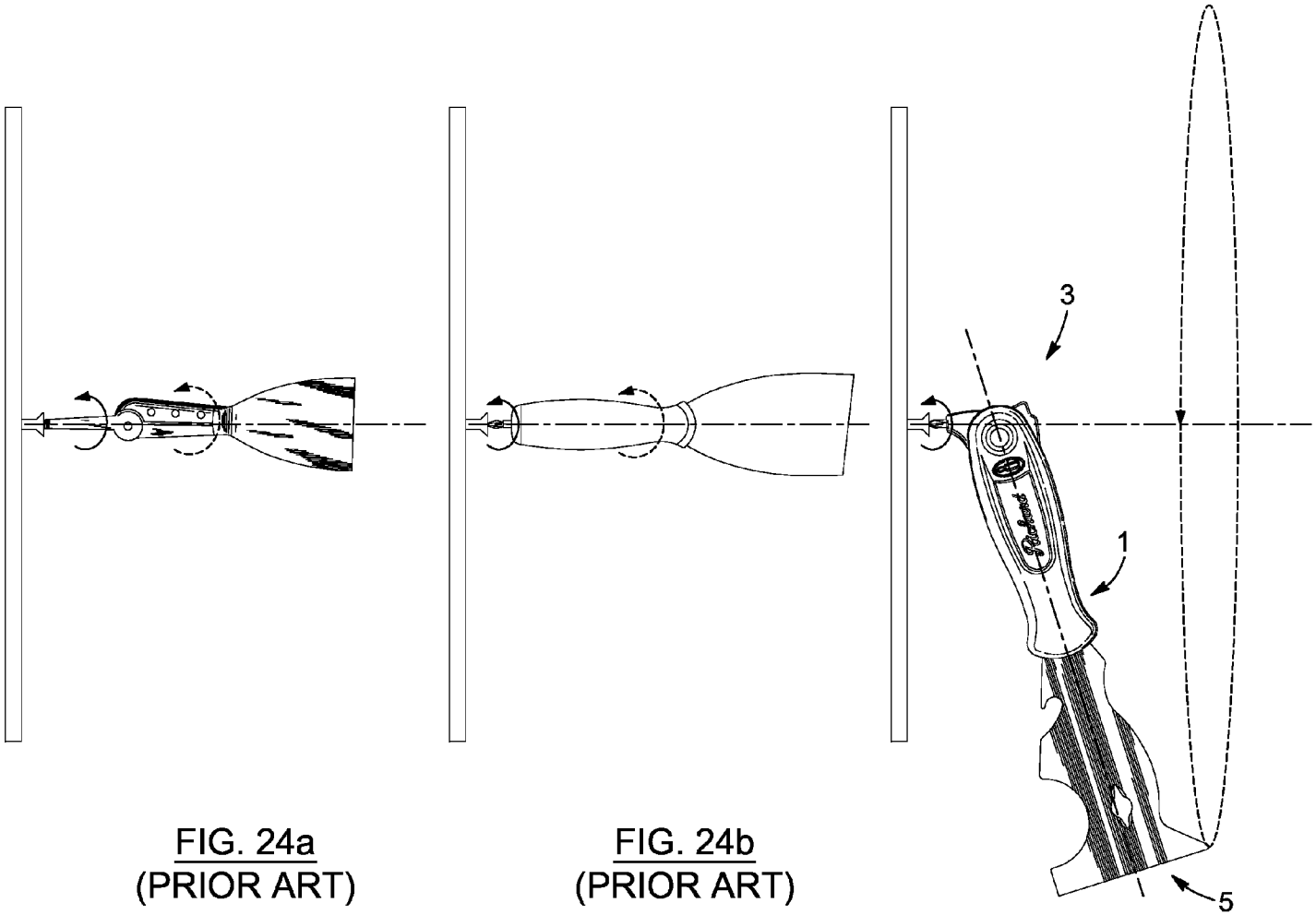
FIG. 24b (PRIOR ART)
FIG. 24a (PRIOR ART)
FIGS. 24*a* and 24*b* are representations of how conventional utility tools with corresponding screw bit mechanisms are used to fasten a screw onto a drywall, contrasted with how it is used with a utility tool according to a preferred embodiment of the present invention, as better illustrated in FIG. 24*c*.

The screw bit 31 of the screw bit mechanism 7, in a closed configuration, is preferably retracted inside of the tool handle 1 for enabling a solid grip on the tool 3 without having any component that extend beyond the natural shape of the tool handle 1. Preferably also, the screw bit 31, in the operating configuration, preferably has an angle of about 30-45 degrees with respect to the longitudinal axis of the tool handle 1, for enabling to have a greater lever effect (or "torque transfer") for screwing fasteners, such as screws and the like, as can be easily understood when referring to FIG. 24*c*, when contrasted with FIGS. 24*a* and 24*b*. Furthermore, the support portion 33 of the screw bit 31, and the screw bit 31 itself, are preferably shaped, positioned and sized so as to define a given space between the wall surface and the tool handle 1, so as to also liberate the blade 5 of the tool 3 from the arm of the user, thus also avoiding or at the very least minimizing undesirable effects to the forearms of the arms of the users. Furthermore, the preferred geometric configuration illustrated in the accompanying drawings also enables for an improved transfer of the force for the screwing of fasteners and the like when compared to the conventional positioning of the screw bit in the axis of the blade (i.e. in parallel), as shown in FIGS. 24*a* and 24*b*.

Preferably also, the tool handle 1 comprises at one extremity, the mechanism with cap for chasing nails, and at the other extremity, an opening for enabling to assemble the tool handle 1 with any other suitable type of blade 5 or complementary component, for assembling the resulting tool 3.

It is worth mentioning also that several modifications could be made to the present tool 3 without departing from the scope of the present invention, as apparent to a person skilled in the art. For example, and as mentioned earlier, the tool handle 1 may be provided with a chamber or other suitable means for allowing an interchangeability of screw bits 31 with the corresponding support portion 33 of the screw bit mechanism 7. Furthermore, the screw bit mechanism 7 could also be altered so as to be triggered via a corresponding activation button, in which case, the screw bit 31 would be preferably spring-loaded, so that upon activation of said activation button, the screw bit 31 and corresponding support portion 33 would be elevated very quickly via the action of the spring load, without having to resort to the activation of a finger receiving portion 57 (this latter component could be thus avoided), as can be easily understood by a person skilled in the art.

As can be easily understood from the accompanying drawings, and depending on the particular applications for which the present tool 3 is intended for, the handle 1 thereof is preferably made of a substantially rigid material, such as plastic, and the like, in order to be able to properly sustain corresponding loads subjected thereto by users or other corresponding tools to be used with the tool. Preferably also, so as to enable a more ergonomic and more comfortable and secure grip of the tool 3, the handle 1 thereof is provided with a corresponding covering intended to that effect. Preferably also, said covering is made of an elastomeric material, such as rubber and the like, for allowing a soft grip ergonomic handling of the tool 3, as can be easily understood by a person skilled in the art.

Figure 6:
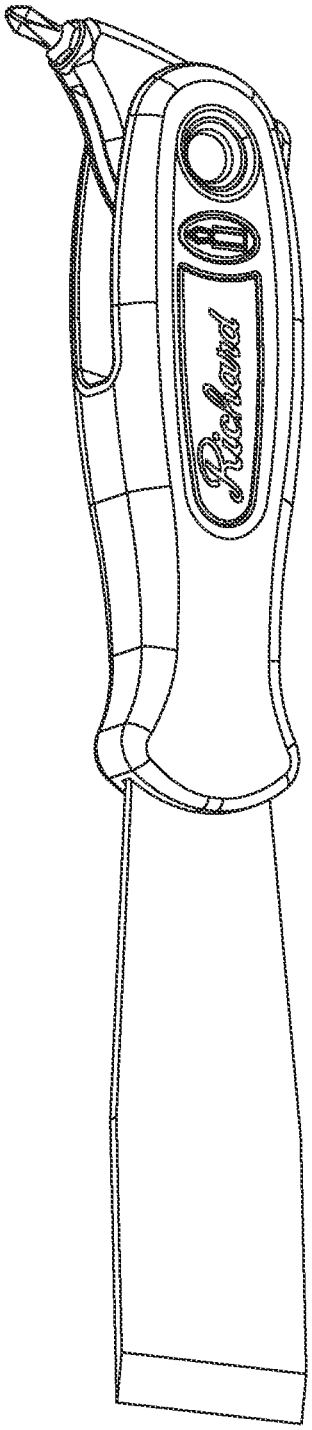
FIG. 6 is a perspective view of a utility tool according to yet another preferred embodiment of the present invention, the tool being also shown with its screw bit assembly in an operating configuration ("opened configuration").

Referring now to the front portion of the tool handle 1, and as better illustrated in FIGS. 6 and 11, the blade 3 with which the treatment of a given surface is to be carried out with the present tool 3 is preferably operatively connected to an extremity of the front portion of the tool 3, and preferably also, rigidly connected thereto by suitable means, whether securely affixed thereto in a permanent manner (with fasteners, via a suitable manufacturing process, etc.), or whether in a removable manner, as can be easily understood by a person skilled in the art. It is worth mentioning also that several modifications could be made to the blade 5 according to the present invention, in that, this component is not necessarily limited to a blade per se, but could rather be replaced by any other suitable component, whether rigid or more flexible, made of plastic for example, which could be used for different purposes with which the present tool 3 could be used and may be useful. Indeed, it is worth mentioning, as can be easily understood by a person skilled in the art, that the blade 5 could be replaced by any other suitable object which could be rigidly or removably mounted to the front portion of the tool handle 1, as aforementioned, so as to enable to properly operate on a surface depending on the surface to be treated (for example, the blade 5 could made out of stainless steel for using with drywall and the like), and other applications with which the present tool 3 could be used and may be useful, as apparent to a person skilled in the art.

Preferably also, the blade 5 of the tool 3 according to the present invention is preferably treated metallurgically by means of a suitable treating process so as to resist to wear when used against different types of material and surfaces.

Preferably also, the covering of the handle 1 or of other portions of the present tool 3, and the rest thereof, are preferably selected so as to be of different colors, and different contrasting colors, so as to provide for a very attractive design of the tool 3, and so as to enable to commercialize the present tool 3 under the colors of the corresponding manufacturers and the like, for example. Furthermore, the handle 1 or other corresponding portions of the tool 3 may be provided with suitable continuous or discontinuous strands of numbers, letters, and/or other symbols conveying information, so as to transmit to the user corresponding information regarding the tool 3, its distributor, and/or its manufacturer, via a corresponding logo for example, or other suitable display of information. For example, a logo could be provided on the present tool 3 according to a double-molding process such as the one described in U.S. Pat. No. 6,726,868 having been obtained by the Assignee of the present application.

As previously explained, the at least one elongated flat blade 5 is adapted for operating on a surface and mounted on a rigid front portion of the tool handle 1. According to one embodiment of the invention, there is provided one blade 5 with an angle preset to optimize the performance of the tool 3. It will be understood by a person skilled in the art that in another embodiment of the invention, more than one blade 5 is preferably used and that there is preferably provided embodiments wherein the blade's angle is adjustable and wherein the blade 5 is interchangeable. For a longer lasting of the blade 5, the blade 5 is preferably quenched or plated, as aforementioned. Thus, the blade 5 stands up to wear and corrosion.

Finally, and according to the present invention, the tool 3 and corresponding parts are preferably made of substantially rigid materials, such as metallic materials (stainless steel, etc.—particularly for the blade), hardened polymers, composite materials, and/or the like, whereas other components thereof (e.g. covering of the handle 1, etc.) according to the present invention, in order to achieve the resulting advantages briefly discussed herein, are preferably made of a suitably malleable and resilient material, such as a polymeric material (plastic, rubber, etc.), and/or the like, depending on the particular applications for which the tool handle 1 and resulting tool 3 are intended for and the different parameters in cause (load applied to the blade 5 and handle 1, required grip of the handle 1, etc.), as apparent to a person skilled in the art.

Furthermore, the present invention is a substantial improvement over the prior art in that, by virtue of its design and components, the tool 3 is simple and easy to use, as well as is simple and easy to manufacture and/or assemble, without compromising the reliability of its functions. Hence, it may now be appreciated that the present invention represents important advantages over other tools known in the prior art, in that the tool handle 1 and resulting tool 3 according to the present invention enable to carry out a variety of tasks with said single resulting tool 3, in a very ergonomic manner, as briefly explained hereinabove.

Of course, numerous modifications could be made to the above-described embodiments without departing from the scope of the invention, as defined in the appended claims.

The invention claimed is:

1. A utility tool comprising:

an elongated handle assembly for manual handling of the utility tool, the handle assembly extending substantially along a longitudinal axis, and having front and rear portions, as well as a peripheral side edge extending between top and bottom gripping surfaces;

a blade having an anchoring portion anchored within the handle assembly and an operating portion extending out from the front portion of the handle assembly, the blade extending along a given plane substantially parallel to a corresponding plane defined by the peripheral side edge;

a screw bit assembly having a screw bit component and a corresponding swiveling support component pivotably mounted onto the handle assembly, the screw bit assembly being operable between a removably fixed non-operating configuration and a removably fixed operating configuration, where in the non-operating configuration, the screw bit component and swiveling support component are nested within a corresponding recess provided on the peripheral side edge of the handle assembly, between the top and bottom gripping surfaces of the handle assembly, and where in the operating configuration, the screw bit component is drawn out of the recess and securely maintained in a fixed configuration so as to be positioned at a fixed slanted angle with respect to the longitudinal axis of the handle assembly; and a biasing assembly contained within the handle assembly and having a resilient component cooperating with an inner component of the swiveling support component so as to securely maintain the screw bit assembly respectively along its corresponding pair of removably fixed configurations, the resilient component of the biasing assembly and inner component of the swiveling support component being configured for automatically urging the screw bit assembly towards the operating configuration when the swiveling support component is located between an operating position and a transitional position, and the resilient component of the biasing assembly and inner component of the swiveling support component being further configured for automatically urging the screw bit assembly towards the non-operating configuration when the swiveling support component is located between a non-operating position and the transitional position;

wherein the inner component of the swiveling support component comprises a cam-shaped component, and wherein the resilient component of the biasing assembly comprises top and bottom ends, the bottom end being securely anchored to the handle assembly and the top end being tapered with respect to the bottom end and being also resiliently displaceable within a given range, the top end of the resilient component pushing against the cam-shaped component for automatically urging the screw bit assembly towards the operating configuration when the swiveling support component is located between the operating position and the transitional position, and for automatically urging also the screw bit assembly towards the non-operating configuration when the swiveling support component is located between the non-operating position and the transitional position;

wherein swiveling support component of the screw bit assembly comprises an inner channel for receiving the top end of the resilient component, said inner channel being positioned, shaped and sized within the swiveling support component for allowing resilient displacements of the top end of the resilient member within the inner channel and against the cam-shaped component when the swiveling support component is operated between its operating and non-operating positions;

wherein the inner channel is defined between a pair of lateral surfaces of the swiveling support component, and wherein the entry to the inner channel is provided on a bottom portion of the swiveling support component;

wherein the swiveling support component is provided with a flat end positioned, shaped and sized to carry out the function of a nailing cap when the screw bit assembly is in the non-operating configuration;

wherein the swiveling support component is provided with a finger receiving portion for enabling a swiveling of the screw bit assembly into the operating configuration via a pressing action by a corresponding finger of a user of the utility tool onto said finger receiving portion, the finger receiving portion being provided adjacent to the entry of the inner channel of the swiveling support component;

wherein the finger receiving portion is provided with a series of corresponding transversal ribs for facilitating an improved grip and corresponding activation of the finger receiving portion;

wherein the flat end is provided on the swiveling support component, within the same plane defined by the peripheral side edge, and wherein the flat end is positioned adjacent to the finger receiving portion;

wherein the handle assembly comprises an inner core made of a substantially rigid material, while comprising corresponding overlaying portions made of an elastomeric material, for improving manipulation and grip of the handle assembly and of the corresponding utility tool, the swiveling support component being pivotably mounted onto the inner core, about the rear portion of the handle assembly;

wherein the swiveling support component is pivotably mounted onto the handle assembly by means of an eyelet, the eyelet providing the utility tool with a corresponding bore extending through the handle assembly, from the top gripping surface to the bottom gripping surface thereof, for enabling to hang the utility tool onto a corresponding support structure; and wherein the bottom end of the resilient component abuts against a distal end of the blade inside an inner core of the handle assembly.

2. A utility tool according to claim 1, wherein the swiveling support component comprises a socket being positioned, shaped and sized for selectively receiving a corresponding screw bit being removably insertable into said socket.

3. A utility tool according to claim 2, wherein the socket is magnetized with respect to the screw bit so as to further retain the screw bit within the socket.

4. A utility tool according to claim 1, wherein the handle assembly of the utility tool is provided with a storing space for storing and allowing an interchangeability of removable screw bits with a corresponding socket of the swiveling support component of the screw bit assembly.

5. A utility tool according to claim 1, wherein the slanted angle is comprised between about 90 degrees and about 150 degrees with respect to the longitudinal axis of the handle, and wherein the swiveling support component is positioned, shaped and sized so to provide a clearance, between a working surface and the handle assembly, for the fingers of a user of the utility tool, when the screw bit is substantially perpendicular with respect to the working surface.

6. A utility tool according to claim 5, wherein the slanted angle is about 120 degrees.

7. A utility tool according to claim 6, wherein an outer contour of the swiveling support component is complementary in shape with respect to a rim of the recess of the peripheral side edge, when the swiveling support component and corresponding screw bit component are nested within the recess.

8. A utility tool according to claim 7, wherein the screw bit assembly is configured so as to be triggered via a corresponding activation button, the swiveling support component being spring-loaded, so that upon activation of the activation button, the swiveling support component and corresponding screw bit component are automatically elevated via the action of the spring load into the operating configuration.

9. A utility tool according to claim 8, wherein the utility tool comprises a first component for setting drywall screws, a second component for opening containers, a third component for cleaning paint rollers, a fourth component for opening paint cans, a fifth component for spreading drywall compound, a sixth component for scraping, a seventh component for closing paint cans, an eight component for scraping concave surfaces, a ninth component for scraping convex surfaces, a tenth component for pulling nails, and an eleventh component for cleaning out cracks.

10. A utility tool according to claim 9, wherein the utility tool is a screw bit taping knife.

* * * * *